US010350742B2

(12) United States Patent
Nitsche et al.

(10) Patent No.: US 10,350,742 B2
(45) Date of Patent: Jul. 16, 2019

(54) PERCUSSION UNIT

(71) Applicant: Robert Bosch GmbH, Stuttgart (DE)

(72) Inventors: Rainer Nitsche, Kirchheim/Teck (DE); Antoine Vandamme, Gerlingen (DE); Thomas Winkler, Stuttgart (DE); Helge Sprenger, Stuttgart (DE); Haris Hamedovic, Moeglingen (DE); Wolfgang Fischer, Gerlingen (DE); Christian Bertsch, Markgroeningen (DE); Mario Eduardo Vega Zavala, Schwieberdingen (DE); Ulli Hoffmann, Niefern-Oeschelbronn (DE); Thilo Henke, Leinfelden-Echterdingen (DE); Achim Duesselberg, Kirchheim Unter Teck (DE)

(73) Assignee: Robert Bosch GmbH, Stuttgart (DE)

( * ) Notice: Subject to any disclaimer, the term of this patent is extended or adjusted under 35 U.S.C. 154(b) by 967 days.

(21) Appl. No.: 14/403,199

(22) PCT Filed: Apr. 24, 2013

(86) PCT No.: PCT/EP2013/058424
§ 371 (c)(1),
(2) Date: Nov. 24, 2014

(87) PCT Pub. No.: WO2013/174594
PCT Pub. Date: Nov. 28, 2013

(65) Prior Publication Data

US 2015/0101835 A1 Apr. 16, 2015

(30) Foreign Application Priority Data

May 25, 2012 (DE) ..... 10 2012 208 902

(51) Int. Cl.
*B25D 11/06* (2006.01)
*B25D 16/00* (2006.01)
(Continued)

(52) U.S. Cl.
CPC ..... *B25D 11/06* (2013.01); *B25D 11/005* (2013.01); *B25D 16/006* (2013.01); *B25F 5/00* (2013.01);
(Continued)

(58) Field of Classification Search
CPC .... B25D 11/06; B25D 16/006; B25D 11/005; B25D 2250/221; B25D 2250/205;
(Continued)

(56) References Cited

U.S. PATENT DOCUMENTS 4,190,781 A 2/1980 Sauerwein et al.
4,763,733 A 8/1988 Neumaier
(Continued)

FOREIGN PATENT DOCUMENTS

CN 1315238 A 10/2001
CN 101497188 A 8/2009
(Continued)

OTHER PUBLICATIONS

International Search Report corresponding to PCT Application No. PCT/EP2013/058424, dated Aug. 8, 2013 (German and English language document) (10 pages).

*Primary Examiner* — Alexander M Valvis
*Assistant Examiner* — Mobeen Ahmed
(74) *Attorney, Agent, or Firm* — Maginot, Moore & Beck LLP

(57) ABSTRACT

Percussion unit, especially for a rotary hammer and/or percussion hammer, comprising a control unit which is designed for controlling a pneumatic percussion mechanism.
(Continued)

According to the disclosure, the control unit comprises at least one load estimation device.

17 Claims, 13 Drawing Sheets

(51) Int. Cl.
*B25D 11/00* (2006.01)
*B25F 5/00* (2006.01)

(52) U.S. Cl.
CPC .. *B25D 2211/003* (2013.01); *B25D 2211/068* (2013.01); *B25D 2250/035* (2013.01); *B25D 2250/131* (2013.01); *B25D 2250/145* (2013.01); *B25D 2250/201* (2013.01); *B25D 2250/205* (2013.01); *B25D 2250/221* (2013.01)

(58) Field of Classification Search
CPC ..... B25D 2211/068; B25D 2250/145; B25D 2250/131; B25D 2250/035; B25D 2211/003; B25D 2250/201; B25F 5/00
USPC ..... 173/5, 6, 7, 9, 11, 176, 181, 201
See application file for complete search history.

(56) References Cited

U.S. PATENT DOCUMENTS 5,584,619 A * 12/1996 Guzzella ..... B23Q 11/04 408/1 R
6,854,529 B2 * 2/2005 Kuntze ..... B25D 16/00 173/1
6,938,702 B2 * 9/2005 Saha ..... E21B 44/06 173/1
6,945,337 B2 * 9/2005 Kawai ..... B25B 21/026 173/176
6,988,734 B2 1/2006 Zierpka
7,334,648 B2 * 2/2008 Arimura ..... B25B 21/02 173/176
2001/0024601 A1 * 9/2001 Miescher ..... B25D 16/006 408/199
2003/0182016 A1 * 9/2003 Fiebig ..... G05B 19/4083 700/168
2003/0205393 A1 * 11/2003 Hoop ..... B25D 17/06 173/2
2004/0065455 A1 * 4/2004 Berger ..... B25D 11/005 173/201
2006/0185869 A1 * 8/2006 Arimura ..... B25B 23/1475 173/176
2007/0034394 A1 * 2/2007 Gass ..... B23B 31/123 173/2
2009/0065226 A1 * 3/2009 John ..... B25D 11/005 173/6
2009/0195204 A1 * 8/2009 Gumpert ..... B25D 11/00 318/460
2010/0270355 A1 * 10/2010 Whitman ..... A61B 17/068 227/176.1
2011/0000688 A1 * 1/2011 Iwata ..... B25B 21/00 173/1
2011/0204119 A1 * 8/2011 McCuen ..... A61B 17/07207 227/175.1
2011/0284255 A1 * 11/2011 Ookubo ..... B23B 45/02 173/109
2011/0315417 A1 * 12/2011 Matsunaga ..... B25B 21/008 173/176
2012/0061116 A1 * 3/2012 Aoki ..... B23D 47/12 173/178
2012/0279736 A1 * 11/2012 Tanimoto ..... B25B 21/02 173/2
2014/0102741 A1 * 4/2014 Sekino ..... B25B 21/02 173/181
2015/0209035 A1 * 7/2015 Zemlok ..... G01D 18/008 73/1.01

FOREIGN PATENT DOCUMENTS

CN 102300677 A 12/2011
CN 102361729 A 2/2012
DE 100 14 314 A1 10/2001
DE 102 12 064 A1 10/2003
DE 10 2011 080 374 A1 2/2013
EP 1 375 077 A2 1/2004
EP 2 036 680 A2 3/2009
EP 2 085 755 A1 8/2009
EP 2 412 484 A1 2/2012
JP 9-267272 A 10/1997
JP 2009-297807 A 12/2009
WO 02/072315 A1 9/2002
WO 2007/141578 A2 12/2007
WO 2009/107563 A2 9/2009
WO 2010/087206 A1 8/2010

* cited by examiner

PERCUSSION UNIT

This application is a 35 U.S.C. § 371 National Stage Application of PCT/EP2013/058424, filed on Apr. 24, 2013, which claims the benefit of priority to Serial No. DE 10 2012 208 902.0, filed on May 25, 2012 in Germany, the disclosures of which are incorporated herein by reference in their entirety.

BACKGROUND

There are already known percussion mechanism units, in particular for a rotary and/or percussion hammer, comprising a control unit that is provided to control a pneumatic percussion mechanism.

SUMMARY

The disclosure is based on a percussion mechanism unit, in particular for a rotary and/or percussion hammer, comprising a control unit that is provided to control a pneumatic percussion mechanism.

It is proposed that the control unit have at least one load estimator. A "percussion mechanism unit" in this context is to be understood to mean, in particular, a unit provided to operate a percussion mechanism. The percussion mechanism unit may have, in particular a control unit. The percussion mechanism unit may have a drive unit and/or a transmission unit, provided to drive the percussion mechanism unit. A "control unit" in this context is to be understood to mean, in particular, a device of the percussion mechanism unit that is provided to control, in particular, the drive unit and/or the percussion mechanism unit by open-loop and/or closed-loop control. The drive unit may be provided, in particular, to drive the percussion mechanism. Further, the drive unit may be provided to drive a tool with a rotary working motion. The drive unit may comprise, in particular, a motor, and a transmission unit for transmitting the drive motion. The control unit may preferably be realized as an electrical, in particular an electronic, control unit. A "rotary and/or percussion hammer" in this context is to be understood to mean, in particular, a power tool provided for performing work on a workpiece by means of a rotary or non-rotary tool, wherein the power tool may apply percussive impulses to the tool. Preferably, the power tool is realized as a hand power tool that is manually guided by a user. A "percussion mechanism" in this context is to be understood to mean, in particular, a device having at least one component provided to generate a percussive impulse, in particular an axial percussive impulse, and/or to transmit such a percussive impulse to the tool disposed in a tool holder. Such a component may be, in particular, a striker, a striking pin, a guide element, such as, in particular, a hammer tube and/or a piston, such as, in particular, a pot piston and/or other component considered appropriate by persons skilled in the art. The striker may transmit the percussive impulse directly or, preferably, indirectly to the tool. Preferably, the striker may transmit the percussive impulse to a striking pin, which transmits the percussive impulse to the tool. "Provided" is to be understood to mean, in particular, specially designed and/or specially equipped. A "load estimator" in this context is to be understood to mean, in particular, a device and/or an algorithm provided to estimate a value and/or characteristic of at least one unknown parameter, at least one input value being taken into account. Preferably, the load estimator takes account of at least one known parameter. "Parameters" in this context are to be understood to mean, in particular, influencing quantities. Parameters may have fixed values, and in particular parameters may be functions of time and/or of a rotary position and/or of further variables. Load estimators are known to persons skilled in the art, from control engineering. The load estimator may preferably be implemented, at least partially, as an algorithm on a computing unit. "Estimate" in this context is to be understood to mean, in particular, that an absolute value and/or value characteristic of the estimated parameter corresponds sufficiently well to an actual parameter for it to suffice as a representation of the actual parameter in the case of a given task. Persons skilled in the art will define a required precision of an estimate, depending on the task. Preferably, the estimate of a parameter may correspond sufficiently well to an actual value if it differs from the actual value by less than 50%, preferably by less than 25%. The control unit may evaluate the estimated parameter. It is possible to dispense with measurement of the actual parameter. The control unit can take account of parameters that can be measured only with a great deal of difficulty. The control unit can take account of parameters that can be measured only in an unreliable manner.

Further, it is proposed that the load estimator be realized as a load observer. A "load observer" in this context is to be understood to mean, in particular, a load estimator that estimates at least one parameter of a physical system, by means of a system model, from at least one input value. A "system model" in this context is to be understood to mean, in particular, a simplified mathematical simulation of a physical system. The system model includes, in particular, a dynamic model of the physical system. A dynamic model takes account, at least partially, of the effects of dynamic inertial forces of the physical system. In particular, the system model constitutes a simplified simulation of the physical system that is reliable for application if an absolute value and/or value characteristic of the estimated parameter corresponds sufficiently well to an actual parameter of the physical system for it to suffice as a representation of the actual parameter in the case of a given task. A "physical system" in this context is to be understood to mean, in particular, one or more components of the percussion mechanism unit, in particular a drive unit. The control unit may evaluate the estimated parameter. The parameter may be estimated in a particularly precise manner by means of a load observer. The load observer may take account of the influence of dynamic forces, at least partially.

Further, it is proposed that the control unit be provided to identify an operating state of the percussion mechanism. Preferably, the control unit is provided to identify and/or distinguish a percussion operating mode and/or idling operating mode of the percussion mechanism. However, the control unit may also be provided to identify other operating states of the percussion mechanism, in particular a percussion frequency, a percussion intensity, or other operating states considered appropriate by persons skilled in the art. A "percussion operating mode" in this context is to be understood to mean, in particular, an operating state of the percussion mechanism in which preferably regular percussive impulses are exerted by the percussion mechanism. An "idling operating mode" in this context is to be understood to mean, in particular, an operating state of the percussion mechanism that is characterized by absence of regular percussive impulses. In particular, in determining the operating state of the percussion mechanism, the control unit may take account of the parameter estimated by the load estimator. Advantageously, the operating state of the percussion mechanism may be identified. The control unit may set operating parameters of the percussion mechanism such that a desired operating state is ensured.

It is proposed that the control unit be provided to process at least one operating parameter. The operating parameter may constitute, in particular, an input value of the load estimator. Preferably, the operating parameter is constituted by an operating parameter of a drive closed-loop control. A "drive closed-loop control" in this context is to be understood to mean, in particular, a closed-loop control unit provided for closed-loop control of a rotational speed of the drive unit of the percussion mechanism unit. An "operating parameter of a drive closed-loop control" in this context is to be understood to mean, in particular, an operating parameter used by the drive closed-loop control for closed-loop control of the drive unit. Preferably, the operating parameter may be an electric power consumption of the drive unit and/or, particularly preferably, a rotational speed of the motor of the drive unit. If a rotational speed at a transmission is captured, the rotational speed of the motor may be calculated from this rotational speed in the case of a known transmission ratio. The control unit may use existing operating parameters. It is possible to dispense with measurement and/or determination of further operating parameters.

Further, it is proposed that the control unit be provided to process the operating parameter as a function of at least one known load and at least one load to be estimated. The load to be estimated may be, in particular, a small and/or rapid, highly dynamic load variation of the drive unit. A "load" in this context is to be understood to mean, in particular, a load moment that acts upon a drive shaft of the drive unit. In particular, the load to be estimated may be caused, at least partially, by the percussion operating mode, in particular by a cyclic movement of a piston of the percussion mechanism. A "small load variation" in this context is to be understood to mean, in particular, a load variation that, in the case of non-regulated operation of the drive unit, causes a rotational speed fluctuation of less than 10%, preferably of less than 5%. A "rapid and/or highly dynamic load variation" in this context is to be understood to mean, in particular, a load variation that occurs within a movement cycle of the piston, in particular during a revolution of an eccentric gear mechanism driving the piston. If known loads are taken into account, the load to be estimated can be determined with greater precision. In particular, the operating parameter can be used to estimate a small and/or highly dynamic load that, if the operating parameter is considered directly, is overlapped by known loads. "Overlapped" in this context is to be understood to mean, in particular, that the unknown parameter is a small proportion of the characteristic of the operating parameter, in particular less than 50%, preferably less than 30%, particularly preferably less than 10%, of an amplitude of the operating parameter. For example, through an operation of performing work with a rotary working motion, by means of a drilling tool, a load moment acting upon the drive unit may effect a greater alteration of a rotational speed or of an electric power consumption than the percussion operating mode of the percussion mechanism. Without known parameters being taken into account, identification of the percussion operating mode may not be possible from consideration of a change in the rotational speed and/or in the electric power consumption. Preferably, the control unit is provided to process a rotational speed of the drive unit as an operating parameter. The rotational speed can be captured in a particularly dynamic manner. There is no need for further sensors. Preferably, the control unit is provided to take account of known loads having a known period. The control unit may be provided to take account of time-periodic loads. Time-periodic loads may be dependent, in particular, on a frequency of an electric power supply to the drive unit. For example, a fluctuation of the electric power supply to the drive unit may correspond to twice the grid frequency of the electric power grid to which the percussion mechanism unit is connected. The control unit may be provided to take account of angle-periodic loads. Angle-periodic loads may be dependent, in particular, on a rotary position of the drive unit. An angle-periodic load may be dependent, in particular, on a transmission ratio of an eccentric gear mechanism that can vary with the rotary position of the drive unit. Preferably, the load estimator determines an estimate of the characteristic of the unknown load over time by subtracting the known quantities from a characteristic of the operating parameter over time, in particular from a measured rotational speed characteristic of the motor of the drive unit. The known loads in this case may be functions in dependence on time and/or on the rotary position of the drive unit. A known load may be a basic and/or setpoint rotational speed of the drive unit. This rotational speed changes only slowly, and may be determined by averaging over time and/or by means of a low-pass filter. Further known loads may be, for example, rotational speed fluctuations resulting from motor cyclic irregularity, from irregular voltage supply to the motor and from variable transmission ratios. These loads may be time-dependent and/or angle-dependent, according to their dependence. Functions of these loads may be determined by persons skilled in the art. The unknown load can be estimated in a particularly precise manner. The estimated load may be particularly suitable for identifying an operating state. The unknown load may preferably be a rotational speed fluctuation caused by the percussion operating mode. Alternatively, the functions of the load may be derived according to time. The basic rotational speed and/or setpoint rotational speed need not be taken into account. The sum of the known loads may be directly proportional to a load moment, in particular to a load moment caused by the percussion operating mode. The percussion operating mode can be identified in a particularly reliable manner.

Further, it is proposed that the control unit comprise a filter unit, which is provided to estimate an unknown load from the operating parameter by filtering with a known frequency band. The filter unit may have, in particular, the function of a load estimator. In particular, the operating parameter may be processed by a bandpass filter. The unknown load may occur in a known frequency band. The bandpass filter may preferably suppress frequencies outside of this frequency band. Effects of known loads having a frequency spectrum that differs from the unknown load may be suppressed. The unknown load may be estimated from the operating parameter by filtering, through the bandpass filter. The control unit can identify the operating state of the percussion mechanism. There is no need for elaborate calculation of the unknown load.

Further, it is proposed that the control unit be provided to determine the operating state by comparing the estimated load with at least one limit value. In particular, a percussion operating mode and/or the idling operating mode can be identified if the estimated parameter and/or a derivation of the estimated load is above or below the limit value.

Further, it is proposed that the control unit have a learning mode for determining at least one known load. In particular, the control unit, when in the learning mode, may learn constant loads, time-dependent loads and/or angle-dependent loads. For the loads, the control unit may have predefined functions, which have scaling parameters. In the learning mode, the percussion mechanism unit may average a rotational speed signal, in a time domain and in an angle domain, over known time-dependent and angle-dependent periods of stored functions for the loads, and set the scaling parameters such that the sum of the known loads results in a least possible deviation from the rotational speed signal. Preferably, a learning phase may be effected in the idling operating mode, in which the operating state to be identified by the control unit is absent. The known loads can be determined, advantageously, by the control unit. Loads that change over the service life of the percussion mechanism unit can be re-learned. This avoids the need for loads to be determined by the user and/or by persons skilled in the art.

It is proposed that the control unit have a dynamic model that is provided to estimate a driving torque of the drive unit. In particular, the control unit may have a dynamic model that is provided to estimate a driving torque of the motor, taking account of the electric power consumption of the motor. Preferably, the dynamic model takes account of a moment of inertia of the motor and/or the rotational speed of the motor and/or a flux-dependent motor constant and/or a friction constant and/or a linked flux and/or a load moment and/or a viscous frictional component and/or a turbulent frictional component. The dynamic model may take account of further influences, in particular also time-periodic and angle-periodic influences. A "flux" in this context is to be understood to mean an electromagnetic flux in the motor. The electromagnetic flux is dependent, in particular, on the electric power consumption of the motor and on the flux-dependent motor constant. The flux-dependent motor constant may be defined by a characteristic curve. The characteristic curve may be calculated, for example, by means of a finite-element model. Methods of determining a dynamic model for calculating a driving torque of a motor, taking account of the electric power consumption and the rotational speed, are known to persons skilled in the art. Preferably, the dynamic model is provided to estimate the load moment of the motor and/or of the drive unit. Preferably, the load observer of the control unit is realized as a Luenberger observer. A "Luenberger observer" in this context is to be understood to mean, in particular, a load observer, known to persons skilled in the art, that compares a value, estimated using a model of the observer, with an actually measured value. The difference may constitute a correcting element of the simulated model. An unknown quantity may be estimated from the difference between the estimated value and the measured value. A "quantity" in this context is to be understood to mean, in particular, a physical quantity. In particular, the model may be provided to estimate the rotational speed of the motor, taking account of the electric power consumption. The Luenberger observer may compare the estimated rotational speed with the measured rotational speed. A correcting element for the load moment may be adapted such that the difference between the estimated rotational speed and the measured rotational speed is minimized. The load observer may use the correcting element for the load moment to estimate the load moment of the motor. Further parameters may be provided, which determine how rapidly the correcting element is varied. These parameters may be selected by persons skilled in the art, in particular in dependence on a frequency spectrum of a parameter to be estimated. The load moment may be suitable for identifying the operating state of the percussion mechanism. In particular, the load moment may be suitable for identifying the percussion operating mode. The control unit may process the load moment in order to identify the operating state. There is no need for sensors for measuring the load moment. The percussion mechanism can be particularly robust and/or inexpensive. The load moment can be estimated in a particularly precise manner by means of the dynamic model. Dynamic effects and/or frictional effects and/or dependence of the motor constant on the electromagnetic flux can be taken into account. Preferably, the dynamic model can be implemented on the computing unit of the control unit. As an alternative to the Luenberger observer, persons skilled in the art may also use another suitable method, for example a Kalman filter, known to persons skilled in the art, for determining a quantity to be estimated, from a difference between the parameter estimated by means of the dynamic model and a measured parameter.

Further, it is proposed to determine model parameters of the dynamic model from a comparison of measured and estimated parameters. In particular, model parameters of the dynamic model may be determined in the learning mode. The learning mode is preferably implemented when the percussion mechanism is in the idling operating mode. The parameter to be estimated, in particular the load moment caused by the percussion operating mode, may be at least largely absent in the idling operating mode. "At least largely" in this context is to be understood to mean, in particular, that the parameters to be estimated assume less than 30%, preferably less than 10% of their value in the operating state to be identified. A difference of the value estimated by means of the dynamic model, in relation to the measured value, in particular of the rotational speed estimated by means of the dynamic model in relation to the measured rotational speed, may be due, in particular, to incorrect model parameters. Persons skilled in the art know various methods of modifying the model parameters in a learning mode, such that the difference is minimized. The dynamic model may include correcting parameters, which cause the estimated rotational speed to converge toward the measured rotational speed. Advantageously, a situation can be achieved wherein model parameters are determined in an automated manner. Changes in the course of the service life of the percussion mechanism can be taken into account.

Further, it is proposed that the control unit be provided to determine the operating state by comparing at least one estimated parameter with at least one limit value. The operating state may be output as a digital signal. In particular, a percussion operating mode can be identified if an estimated parameter exceeds a limit value. The estimated parameter may be, in particular, an estimated load moment. Preferably, the estimated parameter is an estimated load moment caused by the percussion operating mode. Preferably, a plurality of operating states may be assigned to a plurality of limit values of the estimated load moment. Preferably, a slope and/or frequency of an amplitude of the load moment can be assigned to an operating state. In particular, the control unit can identify the percussion operating mode in the case of the frequency of the amplitude of the load moment occurring in a frequency band, that is dependent on rotational speed, in the range of an unexpected percussion frequency of the percussion mechanism. An "unexpected percussion frequency" in this context is to be understood to mean, in particular, a percussion frequency that ensues, in the case of the percussion operating mode of the percussion mechanism, as a result of the drive rotational speed, because of the given transmission ratios of the drive unit of the percussion mechanism. The control unit can determine the operating state in a particularly reliable manner. Disturbing influencing quantities can be eliminated particularly effectively.

Further, it is proposed that the control unit be provided to set at least one operating parameter temporarily to a start value, in at least one operating state, for the purpose of changing from the idling operating mode to the percussion operating mode. "Changing" from the idling operating mode to the percussion operating mode in this context is to be understood to mean starting of the percussion mechanism from the idling operating mode. The change to the percussion operating mode may be effected, in particular, when the percussion mechanism is switched over from the idling mode to the percussion mode. An "operating parameter" in this context is to be understood to mean, in particular, a parameter generated and/or influenced by the percussion mechanism unit for the purpose of operating the percussion mechanism, such as, for example, a drive rotational speed, an operating pressure and or a throttle position. A "start value" in this context is to be understood to mean, in particular, a stable operating parameter that is suitable for reliable starting of the percussion mechanism. "Reliable" in this context is to be understood to mean, in particular, that, when the percussion mechanism is switched over from the idling mode to the percussion mode, the percussion operating mode ensues in more than 90%, preferably more than 95%, particularly more than 99% of cases. "Temporarily" in this context is to be understood to mean, in particular, a limited time period. In particular, the time period may be shorter than 30 seconds, preferably shorter than 10 seconds, particularly preferably shorter than 5 seconds. Reliable starting of the percussion operating mode can be achieved. A percussion operating mode may be possible with operating parameters that are unsuitable for percussion mechanism starting. Operating parameters that are unsuitable for percussion mechanism starting may be reliable as working values. An idling operating mode may be possible with operating parameters that are unsuitable for percussion mechanism starting. Operating parameters that are unsuitable for percussion mechanism starting may be reliable as idling values. Reliability of the percussion mechanism can be increased. A performance capability of the percussion mechanism can be increased. It is proposed that the control unit be provided to set the operating parameter to an above-critical working value, in at least one operating state, in a percussion operating mode. The control unit may be provided, in particular, to set an above-critical working value when a user requests a working value that is above-critical under given conditions. An "above-critical" working value in this context is to be understood to mean, in particular, an operating parameter with which a successful transition from the idling operating mode to the percussion operating mode is not ensured. In particular, in the case of a percussion mechanism in the percussion mode, with an above-critical operating parameter the percussion operating mode may start in fewer than 50%, preferably in fewer than 80%, particularly preferably in fewer than 95% of cases. A relationship between the operating parameter and a percussion amplitude of the striker, or of another component of the percussion mechanism serving to generate percussion, may have, in particular, a hysteresis. An above-critical operating parameter may be characterized, in particular, in that it is above or below a limit value, above or below which a function of the percussion amplitude in dependence on the operating parameter is multi-valued. An above-critical operating value during an already successful percussion operating mode may preferably be distinguished by a stable continuation of the percussion operating mode. A reliable starting of the percussion mechanism may preferably be effected with a start value. Preferably, the start value lies in a range of the operating parameter in which the function of the amplitude in dependence on the operating parameter is unambiguous. With the above-critical operating parameter, a performance of the percussion mechanism can be increased. A performance capability of a power tool equipped with the percussion mechanism can be increased. With the above-critical operating parameter, the percussion mechanism can be operated in a reliable manner. Preferably, the percussion mechanism, in idling mode, may be operated in the idling operating mode with an idling value that corresponds to the above-critical start value. Preferably, for the purpose of starting the percussion mechanism, the operating parameter is set temporarily to the start value. The percussion mechanism may be operated with the above-critical operating parameter in the percussion operating mode and in the idling operating mode. The percussion mechanism may be operated with the operating parameter, selected by the user, in the idling operating mode and in the percussion operating mode. The selected operating parameters can be identified particularly easily by the operator, including in the idling operating mode.

It is proposed that the operating parameter be a throttle characteristic quantity of a venting unit. A "throttle characteristic quantity" in this context is to be understood to mean, in particular, a setting of the venting unit that alters a flow resistance of the venting unit, in particular a flow cross section. A "venting unit" in this context is to be understood to mean, in particular, a ventilation and/or venting unit of the percussion mechanism. The venting unit may be provided, in particular, to balance the pressure and/or volume of at least one space in the percussion mechanism. In particular, the venting unit may be provided for ventilating and/or venting a space, in front of and/or behind the striker in the percussion direction, in a guide tube that guides the striker. Preferably, the operating parameter may be a throttle position of the venting unit of the space disposed in front of the striker in the percussion direction. If a flow cross section is enlarged in the case of this venting unit, venting of the space in front of the striker can be improved. A counter-pressure, against the percussion direction of the striker, can be reduced. A percussion intensity can be increased. If a flow cross section is reduced in the case of this venting unit, venting of the space in front of the striker can be reduced. A counter-pressure, against the percussion direction of the striker, can be increased. A percussion intensity can be reduced. In particular, a return movement of the striker, against the percussion direction, can be assisted by the counter-pressure. Starting-up of the percussion mechanism can be assisted. The operating parameter can ensure reliable start-up of the percussion mechanism. The operating parameter with a reduced flow cross section may be a stable operating parameter. It may be suitable as a start value. The operating parameter with an enlarged flow cross section can be a critical operating parameter in the case of increased performance capability of the percussion mechanism. It can be suitable as a working value.

In an advantageous design of the disclosure, it is proposed that the operating parameter be a percussion frequency. A "percussion frequency" in this context is to be understood to mean, in particular, an averaged frequency with which the percussion mechanism generates percussion impulses when in the percussion operating mode. In particular, the percussion frequency may be dependent on a percussion-mechanism rotational speed. A "percussion-mechanism rotational speed" in this context is to be understood to mean, in particular, a rotational speed of an eccentric gear mechanism that moves a piston of the percussion mechanism. The piston may be provided, in particular, to generate a pressure cushion for applying pressure to the striker. The striker may be moved, in particular, at the percussion frequency by the pressure cushion generated by the piston. There is preferably a direct relationship between the percussion frequency and the percussion-mechanism rotational speed. In particular, the absolute value of the percussion frequency 1/s may be the absolute value of the percussion-mechanism rotational speed revs/s. This is the case if the striker executes one stroke per revolution of the eccentric gear mechanism. In the following, therefore, the terms "frequency" and "rotational speed" are used as equivalents. In the case of designs of a percussion mechanism that are different from this relationship, persons skilled in the art will adapt the following statements accordingly. The percussion-mechanism rotational speed can be set particularly easily by the control unit. A percussion-mechanism rotational speed may be especially suited to one case of performing work. The percussion mechanism may have an especially high performance capability in the case of a high percussion-mechanism rotational speed. In the case of a higher percussion-mechanism rotational speed, the drive unit of the percussion mechanism may be operated with a higher percussion-mechanism rotational speed. A ventilation unit driven by the drive unit may likewise be operated with a higher rotational speed. Cooling of the percussion mechanism and/or of the drive unit by the ventilation unit can be improved. A function of the percussion amplitude of the percussion mechanism may be dependent on the percussion-mechanism rotational speed. In the case of a rotational speed above a limit rotational speed, the function may have a hysteresis, and be multi-valued. Starting of the percussion operating mode, in the case of switchover from the idling mode to the percussion mode, and/or restarting of the percussion operating mode after an interruption of the percussion operating mode may be unreliable and/or impossible. A percussion-mechanism rotational speed below the limit rotational speed may be used as a start value and/or working value for a stable percussion operating mode. A percussion-mechanism rotational speed above the limit rotational speed may be used as a working value for a critical percussion operating mode. Above a maximum rotational speed, a percussion operating mode may be impossible and/or unreliable. "Unreliable" in this context is to be understood to mean, in particular, that the percussion operating mode fails repeatedly and/or randomly, in particular at least every 5 minutes, preferably at least every minute.

Further, a mode change sensor is proposed, which is provided to signal a change of an operating mode. In particular, a change from the idling mode to the percussion mode can be signalled to the control unit by the mode change sensor. The mode change sensor may be provided to detect a contact pressure of a tool upon a workpiece. Advantageously, it can be identified when the user commences a working operation. Particularly advantageously, the mode change sensor can detect a switchover of the percussion mechanism, in particular opening and/or closing of idling openings, and of further openings, of the percussion mechanism that are provided for a change of operating mode. The mode change sensor can detect a displacement of an idling and/or control sleeve provided for changing the operating mode of the percussion mechanism. Advantageously, the control unit can identify when a change of the operating mode of the percussion mechanism occurs. Advantageously, the control unit can alter the operating parameter, in order to assist and/or enable the change of operating mode. The percussion operating mode can be started in a reliable manner.

Further, a hand power tool is proposed, in particular a rotary and/or percussion hammer, comprising a percussion mechanism unit according to the disclosure. The hand power tool may have the advantages described.

Further, a control unit of a percussion mechanism unit is proposed, having the properties described. A percussion mechanism unit comprising the control unit may have the advantages described. The control unit may be such that it can be retrofitted in the case of an existing control unit.

Further, a method is proposed, comprising a percussion mechanism unit having the properties described. The method may be particularly suitable for determining operating parameters.

A preferred control unit comprises a memory unit, which can retrievably store a program, describing the aforementioned method, for execution of the latter, and/or parameters and/or values for executing the aforementioned method, and comprises a computing unit for executing the aforementioned method, or aforementioned program.

BRIEF DESCRIPTION OF THE DRAWINGS

Further advantages are given by the following description of the drawing. The drawing shows four exemplary embodiments of the disclosure. The drawing, the description and the claims contain numerous features in combination. Persons skilled in the art will also expediently consider the features individually and combine them to create appropriate further combinations.

In the drawings.

DETAILED DESCRIPTION

Figure 1:
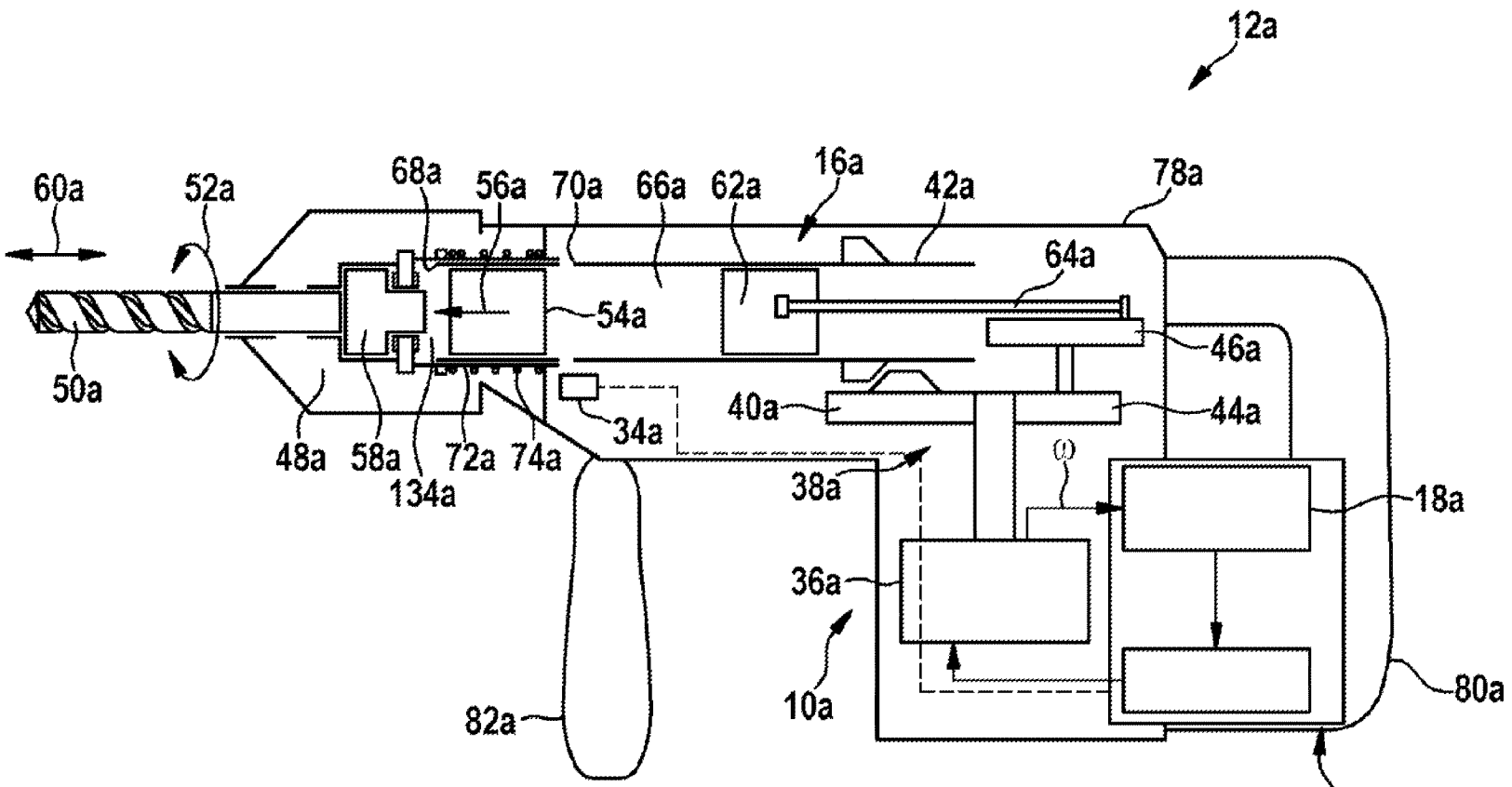
FIG. 1 shows a schematic representation of a rotary and percussion hammer having a control unit according to the disclosure, in a first exemplary embodiment, in an idling mode.
Figure 2:
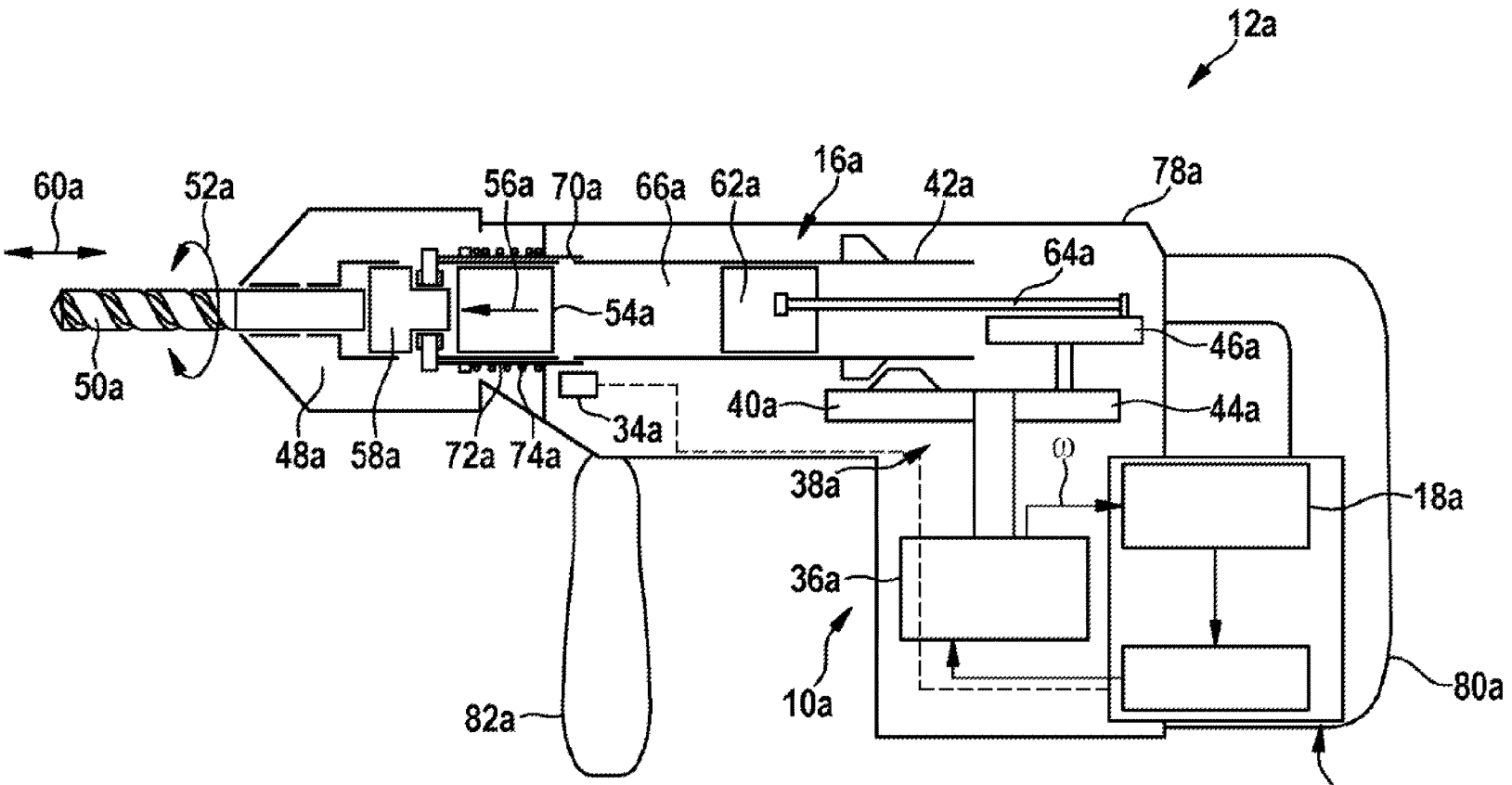
FIG. 2 shows a schematic representation of the rotary and percussion hammer in a percussion mode.
Figure 8:
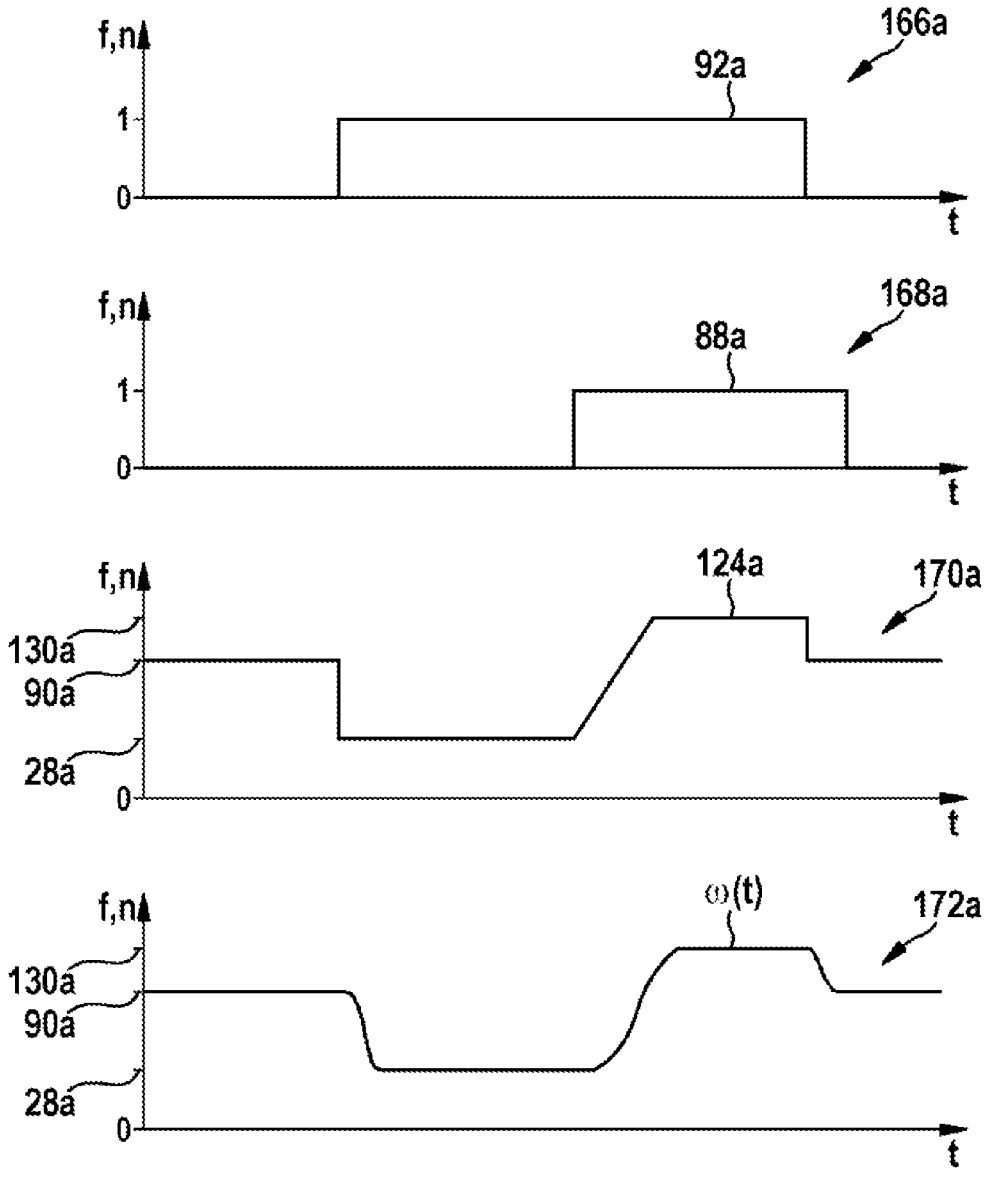
FIG. 8 shows a representation of a sequence diagram of the control unit of the percussion mechanism unit in the case of a change between an idling mode and a percussion mode.

FIG. 1 and FIG. 2 show a rotary and percussion hammer 12*a*, having a percussion mechanism unit 10*a*, and having a control unit 14*a*, which is provided to control a pneumatic percussion mechanism 16*a* by open-loop and closed-loop control. The percussion mechanism unit 10*a* comprises a motor 36*a*, having a transmission unit 38*a* that drives a hammer tube 42*a* in rotation via a first gear wheel 40*a* and drives an eccentric gear mechanism 46*a* via a second gear wheel 44*a*. The hammer tube 42*a* is connected in a rotationally fixed manner to a tool holder 48*a*, in which a tool 50*a* can be clamped. For a drilling operating mode, the tool holder 48*a* and the tool 50*a* can be driven with a rotary working motion 52*a*, via the hammer tube 42*a*. If, in a percussion operating mode, a striker 54*a* is accelerated in a percussion direction 56*a*, in the direction of the tool holder 48*a*, upon impacting upon a striking pin 58*a* that is disposed between the striker 54*a* and the tool 50*a* it exerts a percussive impulse that is transmitted from the striking pin 58*a* to the tool 50*a*. As a result of the percussive impulse, the tool 50*a* exerts a percussive working motion 60*a*. A piston 62*a* is likewise movably mounted in the hammer tube 42*a*, on the side of the striker 54*a* that faces away from the percussion direction 56*a*. Via a connecting rod 64*a*, the piston 62*a* is moved periodically in the percussion direction 56*a* and back again in the hammer tube 42*a*, by the eccentric gear mechanism 46*a* driven with a percussion-mechanism rotational speed 124*a* (FIG. 8). The piston 62*a* compresses an air cushion 66*a* enclosed, between the piston 62*a* and the striker 54*a*, in the hammer tube 42*a*. Upon a movement of the piston 62*a* in the percussion direction 56*a*, the striker 54*a* is accelerated in the percussion direction 56*a*. The percussion operating mode can commence. The striker 54*a* can be moved back, contrary to the percussion direction 56*a*, by a rebound on the striking pin 58*a* and/or by a negative pressure that is produced between the piston 62*a* and the striker 54*a* as a result of the backward movement of the piston 62*a*, contrary to the percussion direction 56*a*, and/or by a counter-pressure in a percussion space 134*a* between the striker 54*a* and the striking pin 58*a*, and can then be accelerated for a subsequent percussion impulse back in the percussion direction 56*a*. Venting openings 68*a* are disposed in the hammer tube 42*a*, in a region between the striker 54*a* and the striking pin 58*a*, such that the air enclosed between the striker 54*a* and the striking pin 58*a* in the striking space 134*a* can escape. Idling openings 70*a* are disposed in the hammer tube 42*a*, in a region between the striker 54*a* and the piston 62*a*. The tool holder 48*a* is mounted so as to be displaceable in the percussion direction 56*a*, and is supported on a control sleeve 72*a*. A spring element 74*a* exerts a force upon the control sleeve 72*a*, in the percussion direction 56*a*. In a percussion mode (FIG. 2), in which the tool 50*a* is pressed against a workpiece by a user, the tool holder 48*a* displaces the control sleeve 72*a* against the force of the spring element 74*a* such that it covers the idling openings 70*a*. If the tool 50*a* is taken off the workpiece, the tool holder 48*a* and the control sleeve 72*a* are displaced by the spring element 74*a* in the percussion direction 56*a* such that openings 76*a* of the control sleeve 72*a* become positioned over the idling openings 70*a*, and release through-passages. A pressure in the air cushion 66*a* between the piston 62*a* and the striker 54*a* can escape through the idling openings 70*a*. In an idling operating mode (FIG. 1), the striker 54*a* is not accelerated, or is accelerated only slightly, by the air cushion 66*a*. In an idling operating mode, the striker 54*a* does not exert any percussion impulses, or exerts only slight percussion impulses, upon the striking pin 58*a*. The rotary and percussion hammer 12*a* has a hand power-tool housing 78*a*, having a handle 80*a* and an ancillary handle 82*a*, by which it is guided by the user.

The control unit 14*a* has a load estimator 18*a*. The load estimator 18*a* is integrated into the control unit 14*a*. The control unit 14*a* is provided to identify an operating state of the percussion mechanism 16*a*. The control unit 14*a* is provided to process at least one operating parameter. The control unit 14*a* is provided to process the operating parameter as a function of at least one known load and of at least one load to be estimated. The load estimator 18*a* of the control unit 14*a* is provided to estimate an unknown drive load $f_L$, using a measured motor rotational speed ω of the motor 36*a*. The unknown drive load $f_L$ is an unknown load moment $M_L$ acting upon the motor 36*a*.

A total moment M denotes the sum of all moments acting on the motor 36*a*. M comprises a drive moment of the motor $M_M$ and the unknown load moment $M_L$. J is the rotational inertia of all parts of the motor 36*a*, transmission unit 38*a* and eccentric gear mechanism 46*a* that rotate with ω, wherein the transmission ratios must be taken into account. The following principle of angular momentum then applies:

$$J\frac{d\omega(t)}{dt} = \sum M$$

The total moment M is the sum of a moment $M_M$ of the motor 36*a* and of moments $M_{Li}$ of loads acting upon the motor 36*a*:

$$J\frac{d\omega(t)}{dt} = M_M + M_{L1} + M_{L2} + \ldots$$

The motor rotational speed ω can be represented as a function of time ω(t), which is composed of a basic rotational speed $\omega_0$ that does not change, or that changes only slowly, and of rapidly changing, highly dynamic components $f_i(t)$, and of the sought drive load $f_L$:

$$\omega(t)=\omega_0+f_1(t)+f_2(t)+\ldots+f_L$$

The functions $f_i(t)$ describe known loads. This equation is obtained by integration of the principle of angular momentum, and consequently the functions $f$ do not have the dimension of a torque and are therefore denoted by the letter $f$ instead of M. The procedure is known to persons skilled in the art. The load to be estimated $f_L$ can be obtained by subtracting the known quantities from the measured motor rotational speed ω(t). In this case, $f_M(t)$ is the function of the moment $M_M$ of the motor 36*a*:

$$f_L=\omega(t)-\omega_0-f_M(t)-f_1(t)-f_2(t)-\ldots$$

The known load components $f_i(t)$ describe, in particular, rotational speed fluctuations caused by variable transmission ratios, motor cyclic irregularities and an irregular voltage supply, e.g. by an activation of the motor. A distinction may be made between time-periodic loads $f_i(t)$ and angle-periodic loads $f_i(\Phi)$. A time-periodic load $f_i(t)$ may be, for example, a voltage fluctuation, in particular having double the grid frequency of an electric power supply to the rotary and percussion hammer 12*a*, and an angle-periodic load $f_i(\Phi)$ may be, for example, a transmission ratio that changes with a rotary position of the eccentric gear mechanism 46*a*. Loads whose characteristic is known precisely will be stored as a computational rule on the control unit 14*a* by persons skilled in the art.

Figure 3:
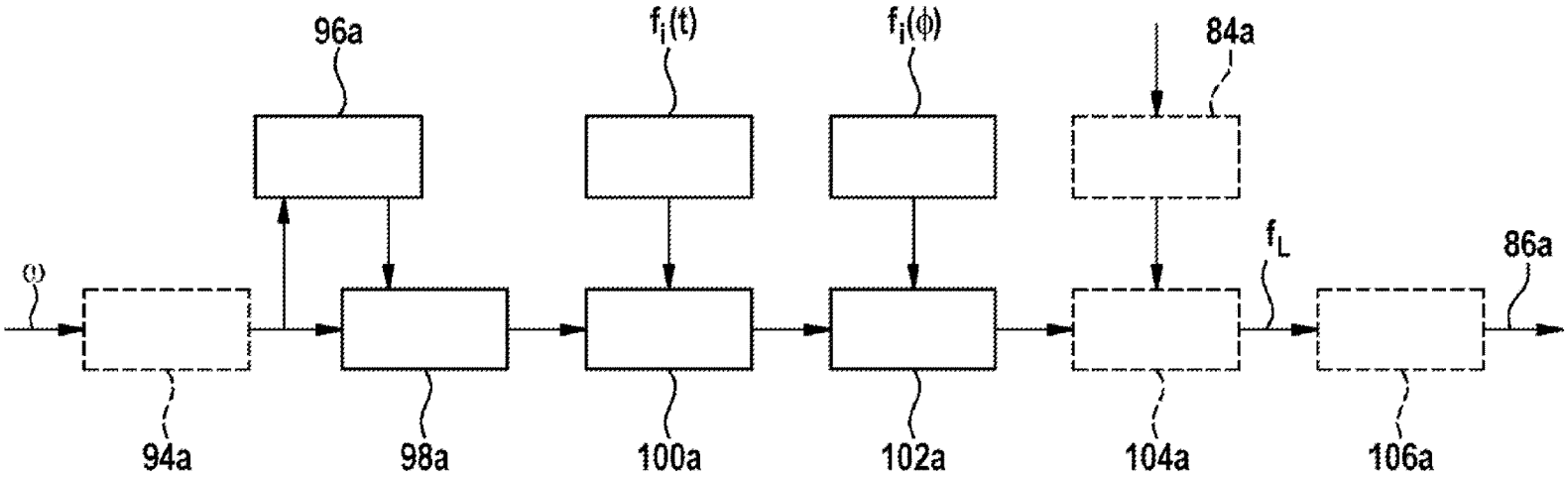
FIG. 3 shows a representation of a sequence diagram of the control unit during operation of the percussion mechanism.

The control unit 14*a* is provided to identify the operating state of the percussion mechanism 16*a*. FIG. 3 shows a sequence diagram of the control unit 14*a* during operation of the percussion mechanism 16*a*. An input is the measured motor rotational speed ω. In a first step 94*a*, a sensor compensation may be effected, depending on a sensor used. In a further step 96*a*, a mean rotational speed is determined from the measured motor rotational speed ω. In a further step 98*a*, a difference of the measured motor rotational speed ω and the mean rotational speed is determined. Time-periodic loads $f_i(t)$ are subtracted in a subsequent step 100*a*, and angle-periodic loads $f_i(\Phi)$ are subtracted in a subsequent step 102*a*. Optionally, influencing quantities 84*a* calculated from further input quantities may be subtracted in a step 104*a*. The result is the characteristic of the load to be estimated $f_L$, which may be further analyzed and/or filtered in a further step 106*a*. In particular, patterns may be processed, in particular a periodicity having an expected percussion frequency. The estimated load is output as a load quantity 86*a*. The operating state is determined by comparison of the load quantity 86*a* with a limit value. By means of this comparison, the control unit 14*a* can determine the operating state of the percussion mechanism 16*a*, in particular the percussion operating mode and the idling operating mode.

Figure 4:
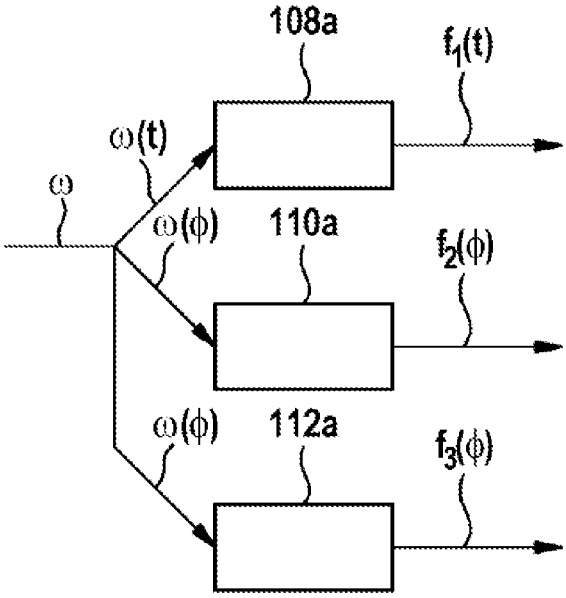
FIG. 4 shows a representation of a sequence diagram of the control unit in a learning mode.

FIG. 4 shows a representation of a sequence diagram of the control unit in a learning mode, for the determination of known loads. The measured motor rotational speed ω is calculated as a function of time t (time domain) ω(t) based on time, and as a function of an angle Φ (angle domain) ω(Φ) based on angle. In an angle domain, it is possible to identify, in particular, periodic influences that are dependent on the rotary position of the eccentric gear mechanism 46*a* and/or of the motor 36*a*. In a step 108*a*, ω(t) is determined over a period $t_1$ from $f_1(t)$. The result is the learned characteristic of the known load $f_1(t)$. In a step 110*a*, ω(Φ) is determined over the periods $\Phi_2$ from $f_2(\Phi)$ and, in a step 112*a*, over the period $\Phi_3$ from $f_3(\Phi)$. The result is the learned characteristics of the known loads $f_2(\Phi)$ and $f_3(\Phi)$. The periods on an angle basis Φ are dependent on transmission ratios of the influences causing these loads to the motor rotational speed ω. Depending on the number of angle-periodic loads and time-periodic load components taken into account, these are determined from the measured motor rotational speed ω in the manner described. Persons skilled in the art will appropriately define the number of loads $f_i$ to be learned. A greater number i increases the accuracy of determination of the load to be estimated $f_L$, and increases the effort required for calculating and defining and/or learning the loads. Advantageously, learning occurs in the idling mode, without influence of the load to be estimated $f_L$. The determination of the known loads $f_i$ in the learning mode is explained further in the following FIGS. 5 and 6.

Figure 5:
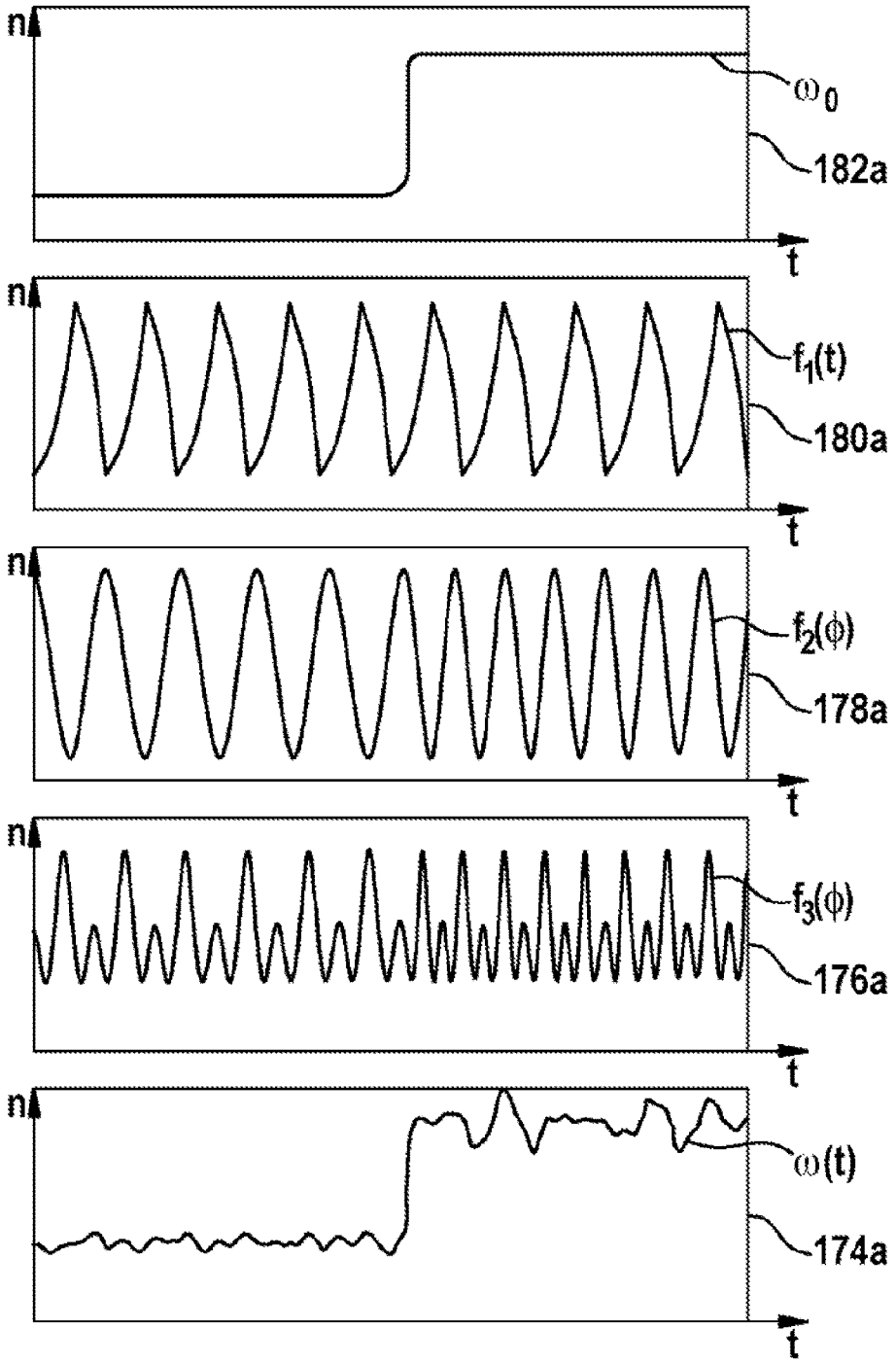
FIG. 5 shows a representation of parameters that influence a rotational speed signal.

FIG. 5 shows a representation of parameters that influence the measured motor rotational speed ω. The parameters are the loads $f_i$ (t), $f_2(\Phi)$ and $f_3(\Phi)$. The lowermost diagram 174*a* shows the characteristic of the measured motor rotational speed ω(t) in the time domain, which includes the influence of loads $f_i$. The diagrams 176*a*, 178*a*, 180*a*, from the bottom upward, show characteristics of two angle-periodic loads $f_2(\Phi)$ and $f_3(\Phi)$ with a differing period and a time-periodic load $f_1(t)$. The topmost diagram 182*a* shows the characteristic of the basic rotational speed $\omega_0$. The basic rotational speed $\omega_0$ remains unchanged over a relatively long period, and may assume a new value upon a change of operating mode. The basic rotational speed $\omega_0$ corresponds, for example, to a rotational speed setpoint value of the motor 36*a* for a desired percussion frequency.

Figure 6:
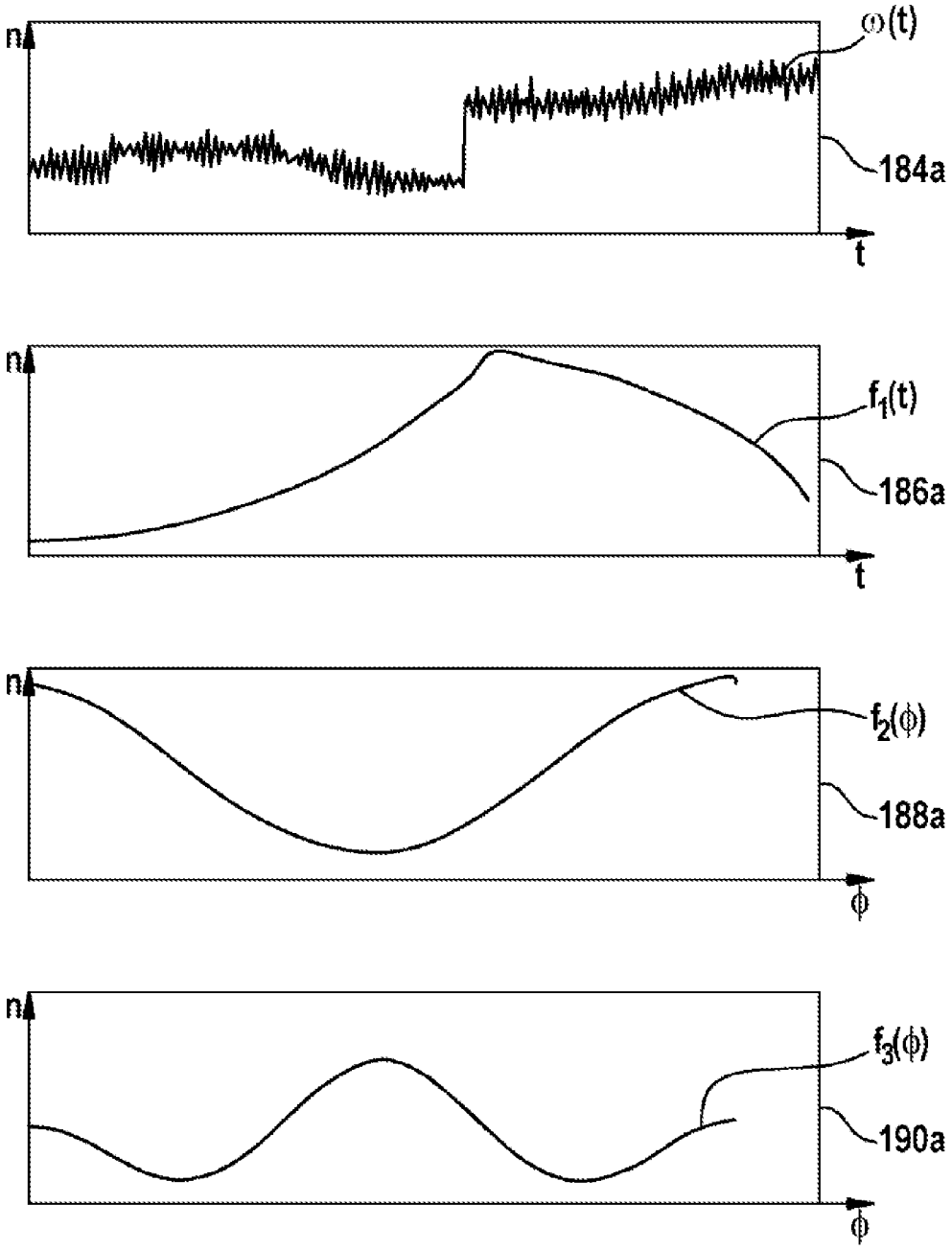
FIG. 6 shows a representation of parameters learned in the learning mode.

FIG. 6 shows a representation of the characteristics of parameters learned in the learning mode. The learned parameters are the learned characteristics of the loads $f_1(t)$, $f_2$ (Φ) and $f_3(\Phi)$. The topmost diagram 184*a* shows the measured motor rotational speed ω(t) in the time domain. Shown beneath are learned characteristics of the loads $f_1(t)$, $f_2(\Phi)$ and $f_3(\Phi)$, in diagram 186*a* by averaging over the period $t_1$ from $f_1(t)$, in diagram 188*a* by averaging over the period $\Phi_2$ from $f_2(\Phi)$, and in diagram 190*a* by averaging over the period $\Phi_3$ from $f_3(\Phi)$. In the present example, the period $\Phi_3$ from $f_3(\Phi)$ is one revolution of the motor 36*a*, and the period $\Phi_2$ from $f_2$ (Φ) is one revolution of the eccentric gear mechanism 46*a*.

The control unit 14*a* is provided to set at least one operating parameter temporarily to a start value 28*a*, in at least one operating state, for the purpose of changing from the idling operating mode to the percussion operating mode. The start value 28*a* may be, in particular, a percussion frequency at which a reliable percussion mechanism start is possible.

Figure 7:
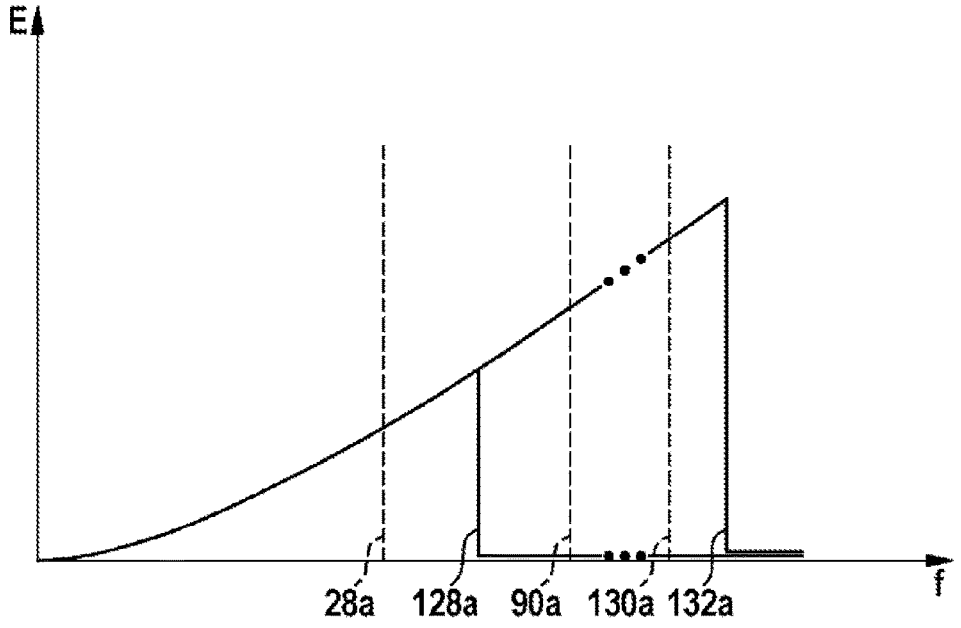
FIG. 7 shows a schematic representation of a possible definition of a start value, a limit value, a working value and a maximum value.

FIG. 7 shows a percussion energy E as a function of the frequency f and a possible definition of the start value 28*a*, a limit frequency 128*a*, a working frequency 130*a* and a maximum frequency 132*a* of the percussion frequency of the percussion mechanism 16*a*. In the case of a change of operating mode to the percussion mode, a reliable percussion mechanism start occurs below the limit frequency 128*a*. If, in the percussion operating mode, the percussion frequency, starting from a value below the limit frequency 128*a*, is increased into the range between the limit frequency 128*a* and the maximum frequency 132*a*, the percussion mechanism remains in the percussion operating mode as the percussion energy E increases. Above the limit frequency 128*a*, a change from the idling operating mode to the percussion operating mode does not occur, or occurs only in few cases; starting from the idling operating mode, the striker 54*a* cannot follow, or can scarcely follow, the movement of the piston 62*a*. Above the maximum frequency 132*a*, a percussion operating mode terminates in most cases. For the percussion operating mode, a working frequency 130*a* can be set after a percussion mechanism start has been effected, and the performance capability of the percussion mechanism 16*a* can thus be increased, as compared with operation below the limit frequency 128*a*. A percussion frequency or percussion mechanism rotational speed 124*a* above this maximum frequency 132*a* is not usable. The percussion mechanism rotational speed 124*a* in this case corresponds to the rotational speed of the eccentric gear mechanism 46*a*, and thus to the percussion frequency. Optionally, an idling value 90*a* may be defined for the idling operating mode, which idling value is advantageously higher than the start value 28*a* and lower than the working frequency 130*a*.

A mode change sensor 34*a* is provided to signal a change of the operating mode. The mode change sensor 34*a* transmits a signal 92*a* (FIG. 8) to the control unit 14*a* when the control sleeve 72*a* is displaced, such that the idling openings 70*a* are closed and the percussion mechanism 14*a* changes from the idling mode to the percussion mode. In particular, if a percussion frequency is selected that is higher than a start value 28*a* at which a reliable percussion mechanism start is possible, the control unit 14*a* first reduces the percussion frequency to the start value 28*a*. If the change from the idling operating mode to the percussion operating mode is identified by means of the load estimator 18*a*, the control unit 14*a* sets the percussion frequency to the selected percussion frequency.

FIG. 8 shows a sequence diagram of the operation of the percussion mechanism unit 10*a*. The diagram 166*a* shows the signal 92*a* of the mode change sensor 34*a*, wherein the value "1" signals the percussion mode. The percussion mechanism 16*a* is changed from the idling mode to the percussion mode if the mode change sensor 34*a* signals the change of the operating mode. The diagram 170*a* shows a setpoint value of the percussion-mechanism rotational speed 124*a* corresponding to the percussion frequency. The percussion-mechanism rotational speed 124*a* and the motor rotational speed ω(t) are used as equivalents here; for specific numerical values, it is necessary to take account of a transmission ratio between the motor 36*a* and the eccentric gear mechanism 46*a*. In the case of the percussion mode being identified, the setpoint value of the percussion-mechanism rotational speed 124*a* is lowered to the start value 28*a*. The diagram 168*a* shows a signal 88*a* of the load estimator 18*a*, wherein the value "1" signals the percussion operating mode. As soon as the percussion operating mode commences, the setpoint value of the percussion-mechanism rotational speed 124*a* is raised to the percussion-mechanism rotational speed 124*a* that corresponds to the working frequency 130*a*, wherein a delay parameter determines a slope of the rise. The percussion operating mode is then maintained until the mode change sensor 34*a* signals the change to the idling mode. The motor rotational speed ω(t) is represented in the lowermost diagram 172*a*.

The following description and the drawings of further exemplary embodiments are limited substantially to the differences between the exemplary embodiments and, in principle, reference may also be made to the drawings and/or the description of the other exemplary embodiments in respect of components having the same designation, in particular in respect of components having the same reference numerals. To differentiate the exemplary embodiments, the letters b, c and d have been appended to the references of the further exemplary embodiments, instead of the letter a of the first exemplary embodiment.

Figure 9:
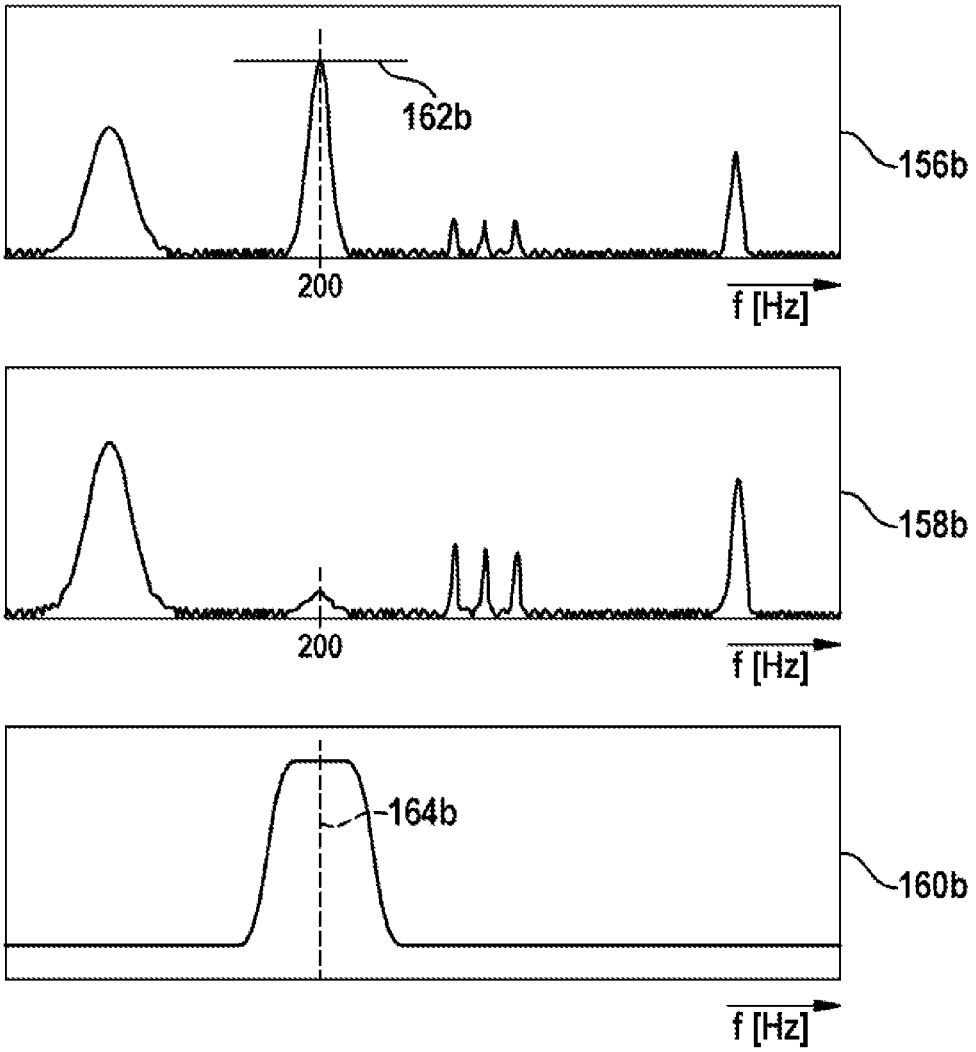
FIG. 9 shows a representation of signal spectra of a rotary and percussion hammer in a second exemplary embodiment, in various operating states.

FIG. 9 shows a representation of signal spectra of a rotary and percussion hammer, not represented in greater detail here. The rotary and percussion hammer comprises a percussion mechanism unit, in a second exemplary embodiment that differs from the preceding exemplary embodiment in that a load estimator includes a filter unit, which is realized as a bandpass filter. The bandpass filter suppresses components of a rotational speed signal outside of a known frequency band excited by a percussion frequency. The percussion frequency corresponds to a rotational speed of an eccentric gear mechanism that drives a piston of a percussion mechanism. The percussion frequency excites oscillations having the percussion frequency itself, and/or oscillations having a multiple of the percussion frequency. A suitable frequency band that can be passed by the bandpass filter therefore lies in the range of the percussion frequency or a multiple of the percussion frequency. Depending on user settings, the percussion frequency lies in a range of 15 Hz-70 Hz. In FIG. 9, a percussion frequency of 40 Hz has been set. This frequency is not visible in the signal spectrum 156*b* during percussion operation. In the case of the rotary and percussion hammer of the second exemplary embodiment, a clear maximum 162*b*, having five times the percussion frequency, at 200 Hz, is clearly visible in the signal spectrum 156*b*. This is almost entirely absent in the signal spectrum 158*b* in the idling operating mode. In this exemplary embodiment, therefore, a mid-frequency 164*b* of a frequency response 160*b* of the bandpass filter is fixed to 5 times the percussion frequency. In the case of adjustment of the percussion frequency, or of the rotational speed of the eccentric gear mechanism, the mid-frequency 164*b* is altered accordingly. The clear maximum 162*b* in the case of five times the percussion frequency in the percussion operating mode is suitable for determining an operating state of the percussion mechanism, in particular an idling operating mode and the percussion operating mode. If a signal, present at an output of the bandpass filter, that has been filtered by the bandpass filter exceeds a defined threshold value, the percussion operating mode is identified. The threshold value, the mid-frequency 164*b* and a bandwidth of the bandpass filter will be appropriately defined in trials by persons skilled in the art. In the exemplary embodiment, the threshold value can be set by means of an operating element, not represented in greater detail.

Figure 10:
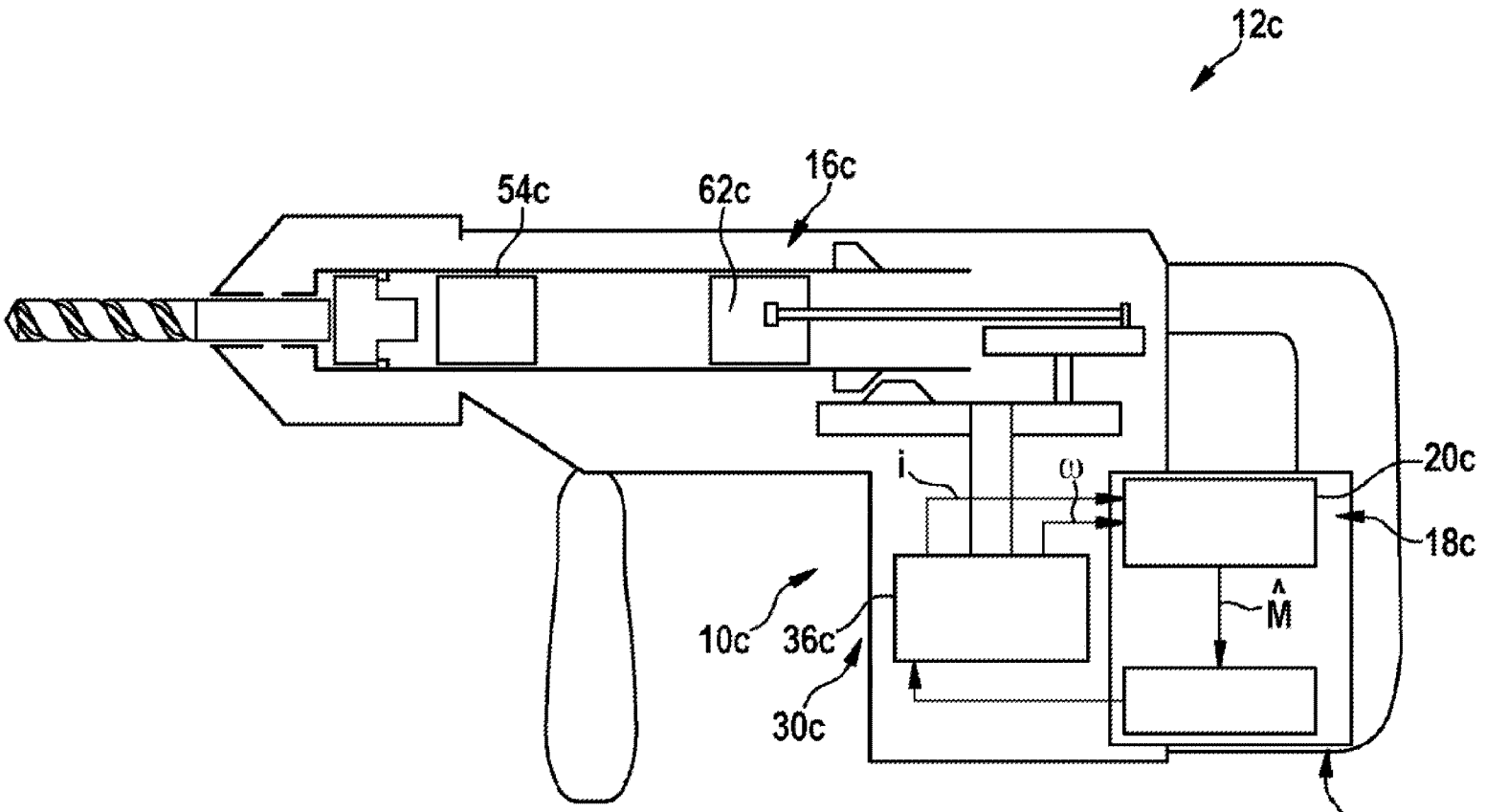
FIG. 10 shows a schematic representation of a rotary and percussion hammer in a third exemplary embodiment, in an idling mode.
Figure 11:
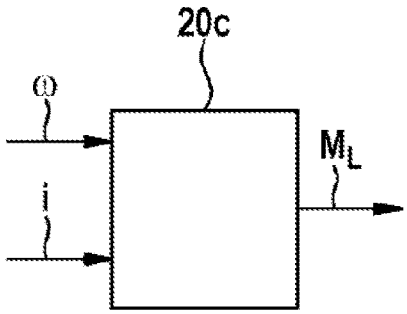
FIG. 11 shows a representation of a block diagram of a load observer.
Figure 12:
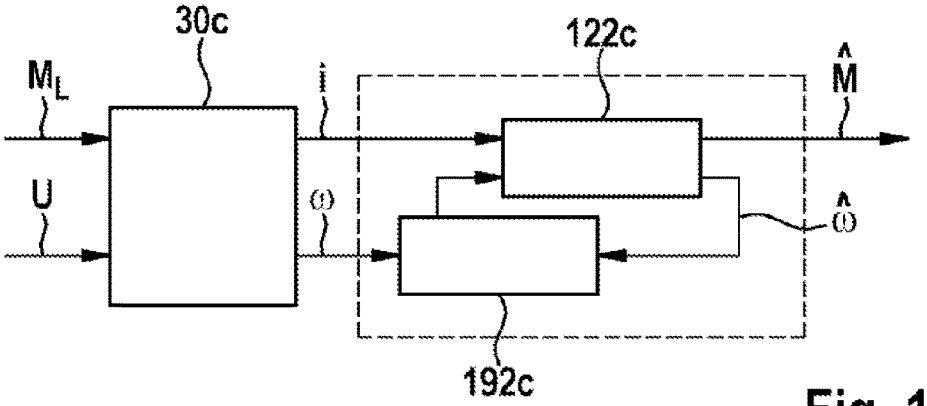
FIG. 12 shows a representation of a system comprising the load observer and a drive unit.

FIG. 10 shows a rotary and percussion hammer 12*c* having a percussion mechanism unit 10*c*, having a control unit 14*c* and a percussion mechanism 16*c*, in a third exemplary embodiment. The percussion mechanism unit 10*c* differs from the first exemplary embodiment in that a load estimator 18*c* is realized as a load observer 20*c*. The load observer 20*c* has a dynamic model, which is provided to estimate a load moment $\hat{M}_L$ of a motor 36*c* of a drive unit 30*c* (FIG. 10). The load observer 20*c* determines the load moment $M_L$ from a motor rotational speed ω and a motor current i of the motor 36*c* of the drive unit 30*c* (FIG. 11). FIG. 12 shows a system comprising the load observer 20*c* and the drive unit 30*c* operated with a voltage U. By means of a simulation element 122*c* of the dynamic model and the correcting element 192*c*, the load observer 20*c* uses the motor current i and the motor rotational speed ω to estimate the load moment $\hat{M}_L$. The basis of the load observer 20*c* is a model of the motor 36*c*, as a basis of the estimation algorithm:

$$J_M \frac{d\omega}{dt} = \frac{c(\Psi)i}{M_M} - M_L - e - a\omega - b\omega^2$$

In this case, $J_M$ is the moment of inertia of the motor 36*c*, ω is the motor rotational speed of the motor 36*c*, *c* is the flux-dependent motor constant, Ψ is the linked flux, $M_L$ is the load moment acting on the motor 36*c*, *e* is a constant frictional component, aω is a viscous frictional component and $b\omega^2$ is a turbulent frictional component.

Figure 13:
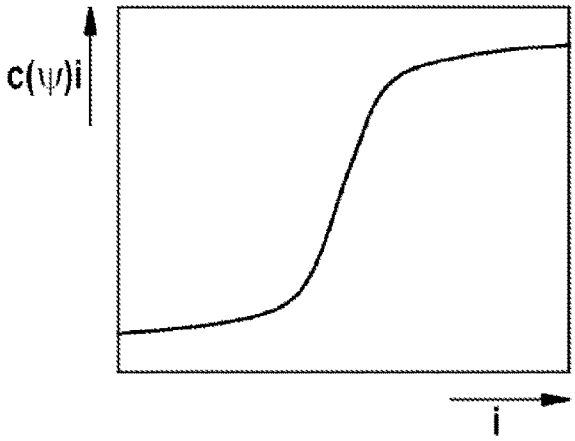
FIG. 13 shows a representation of a motor characteristic curve.

FIG. 13 shows a characteristic curve c(Ψ)i=c(i) of a flux-dependent motor constant for determination of the drive moment $M_M$ as a function of the motor current i. The drive moment $M_M$ is the moment that exerts a magnetic field, caused by the motor current i, upon the motor 36*c*. This characteristic curve may be determined by means of a finite-element model of the motor 36*c*, or by another method considered appropriate by persons skilled in the art. In the case of a direct-current motor, the motor constant is constant, and not dependent on Ψ, such that this relationship is simplified.

It is assumed that a load moment $M_L$ changes only slowly with time, i.e. that the following applies approximately:

$$\frac{dM_L}{dt} = 0$$

The load observer 20*c* is realized as a Luenberger observer, known to persons skilled in the art, in which the motor rotational speed ω of the motor 36*c* estimated by the simulation element 122*c* of the dynamic model is compared with the actual rotational speed. In the following equation of a dynamics of the load observer, in which the constant frictional component and the turbulent frictional component have been disregarded, the estimated states are denoted by $\hat{\omega}$, $\hat{M}$:

$$J_M \frac{d\hat{\omega}}{dt} = c(\Psi)i - \hat{M}_L - a\hat{\omega} + l_1(\omega - \hat{\omega})$$

$$\frac{d\hat{M}_L}{dt} = l_2(\omega - \hat{\omega})$$

$l_1$ and $l_2$ represent correcting element 192*c* of the load observer 20*c*. Through appropriate selection of the coefficients $l_1$ and $l_2$, it is possible to influence the observer dynamics of the observer, i.e. the speed with which the estimated motor rotational speed $\hat{\omega}$ converges with the measured motor rotational speed ω in the case of a deviation. Persons skilled in the art will select a suitable observer dynamics to enable identification of an influence of the part of the load moment $M_L$ that is caused by an operating state to be identified. It is advantageous to select an observer dynamics that corresponds at least to the duration of a movement cycle of a piston 62*c* and/or of a percussion cycle of a striker 54*c* of the percussion mechanism 16*c*. The load moment $\hat{M}_L$ estimated by the load observer 20*c* corresponds in this case to a mean value of a load moment $M_L$ present at the motor 36*c* during a percussion cycle. This mean value is influenced substantially by a piston movement, and differs significantly in a percussion operating mode and in an idling operating mode of the percussion mechanism 16*c*.

Techniques for determining the coefficients $l_1$ and $l_2$ for designing the observer dynamics are known to persons skilled in the art. If the load moment $\hat{M}_L$ exceeds a threshold value, a percussion operating mode can be identified. Moreover, a characteristic of the load moment $\hat{M}_L$ is recorded by the control unit 14*c*. A service state of the rotary and percussion hammer 12*c* can be deduced from a long-term trend of the load moment $\hat{M}_L$. A rise in the mean load moment $\hat{M}_L$, in particular in the idling operating mode, is an indication of increasing internal friction of the rotary and percussion hammer 12*c*. This is an indication of dirt accumulation, inadequate lubrication or further wear phenomena. A recommended service of the rotary and percussion hammer 12*c* is signalled to a user by a service light, not represented in greater detail here, as soon as a limit value of the mean load moment $\hat{M}_L$ is exceeded and/or the mean load moment $\hat{M}_L$ rises sharply in a time period. In the exemplary embodiment, a recommended service is signalled if, in the idling operating mode, the mean load moment $\hat{M}_L$ is more than 50% higher than a reference value.

Figure 14:
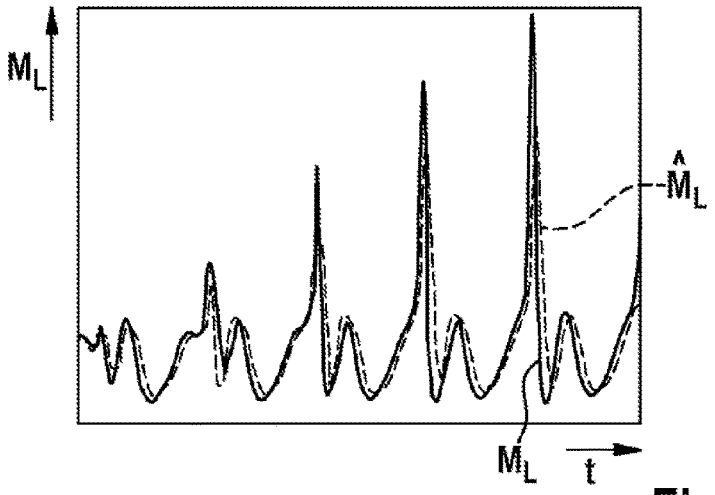
FIG. 14 shows an exemplary representation of an estimated and a measured load moment.

FIG. 14 shows, exemplarily, the characteristic of the actual load moment $M_L$ and of a load moment $\hat{M}_L$ estimated by the load observer 20*c*. The load observer 20*c* is implemented, advantageously, on the control unit 14*c*. The estimated load moment $\hat{M}_L$ may be used on the control unit 14*c* as an input quantity of a control loop algorithm, for example for closed-loop control of the motor 36*c*. In the percussion operating mode, the load moment $\hat{M}_L$ rises as a result of a periodically changing air pressure of an air spring between the striker 54*c* and the piston 62*c*, such that the air pressure can be estimated using the load moment $\hat{M}_L$. A control loop algorithm of the motor 36*c* can thus take account of the air pressure of the air spring. The period corresponds to the percussion frequency and to the rotational speed of an eccentric gear mechanism 46*c*. There is no need for measurement of the load moment $M_L$. Advantageously, the load observer 20*c* is implemented in a time-discrete form, for the purpose of calculation, on a digital signal processor of the control unit 14*c*. The transformation of the equations is effected by a Tustin approximation (bilinear approximation), known to persons skilled in the art.

Figure 15:
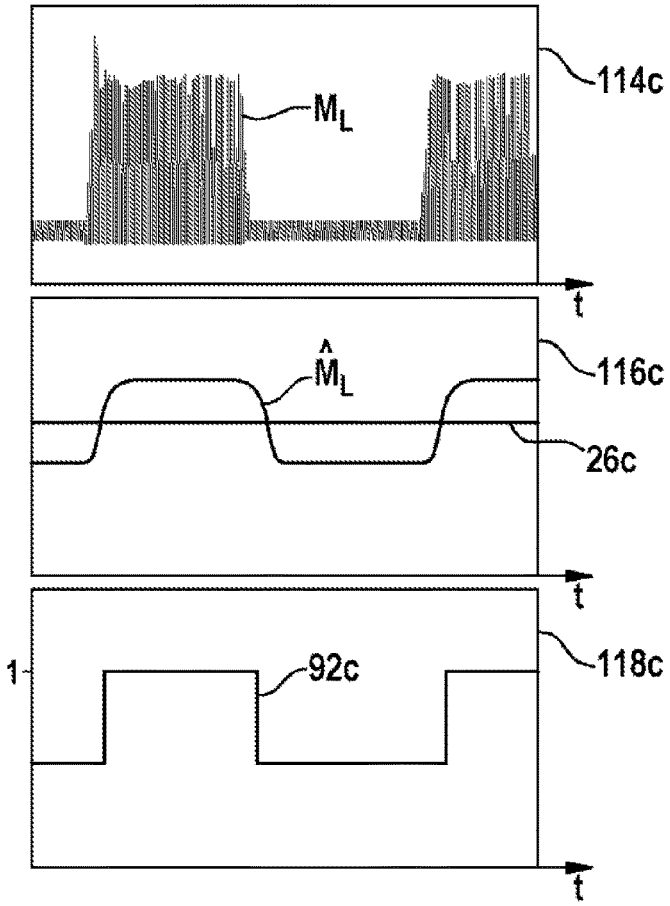
FIG. 15 shows an exemplary representation of the characteristic of the measured and the estimated load moment, and of an operating state of a percussion mechanism.

The operating state is determined by a comparison of the estimated load with at least one limit value 26*c*. The upper diagram 114*c* of FIG. 15 shows a characteristic of the load moment $M_L$, the middle diagram 116*c* shows a characteristic of the load moment $\hat{M}_L$ estimated by the load observer 20*c*, and the lower diagram 118*c* shows a signal 92*c* representing the operating state, wherein a value of "1" corresponds to the operating state "percussion operating mode", and a value of "0" corresponds to the operating state "idling operating mode". The observer dynamics has been selected such that the estimated load moment $\hat{M}_L$ converges during the duration of a percussion cycle, such that the estimated load moment $\hat{M}_L$ corresponds to a smoothed estimated load moment $\hat{M}_L$. The limit value 26*c* is set such that, in the case of a comparison of the estimated load moment $\hat{M}_L$ with the limit value 26*c*, the estimated load moment $\hat{M}_L$ in the percussion operating mode is greater than the limit value 26*c*, and in the idling operating mode is less than the limit value 26*c*. In the example, the limit value 26*c* is half the mean estimated load moment $\hat{M}_L$ in the percussion operating mode. As a result of the smoothing of the estimated load moment $\hat{M}_L$, owing to the selected observer dynamics, the estimated load moment $\hat{M}_L$ remains continuously above the limit value 26*c* during the percussion operating mode. The control unit 14*c* furthermore includes a protective circuit, which switches off the drive unit 30*c* of the percussion mechanism 16*c* on account of overload if a maximum value 126*c* of the estimated load moment $\hat{M}_L$ is exceeded.

Figure 16:
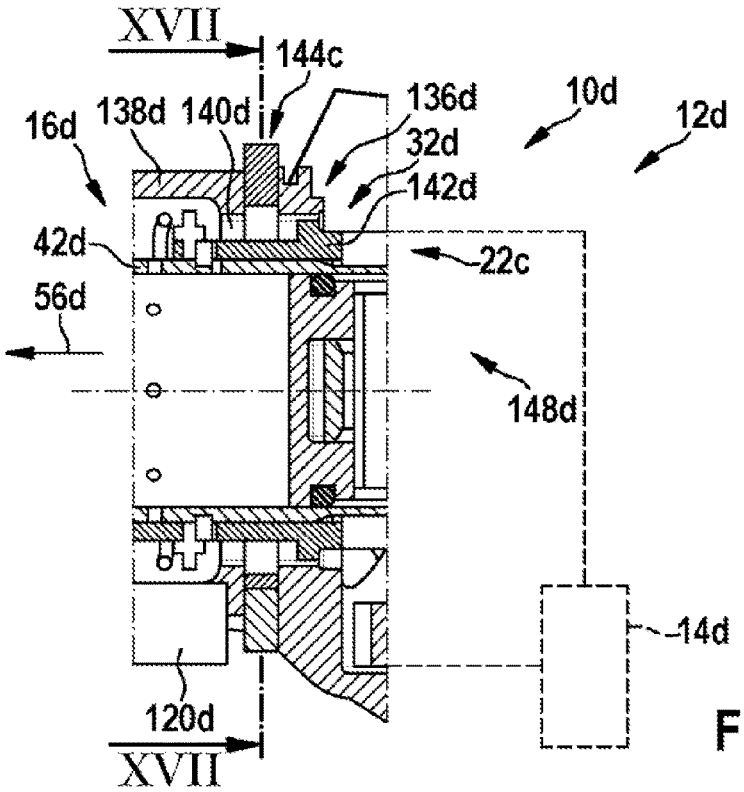
FIG. 16 shows a schematic representation of a venting unit of a percussion mechanism of a rotary and percussion hammer comprising a percussion mechanism unit, in a fourth exemplary embodiment.
Figure 17:
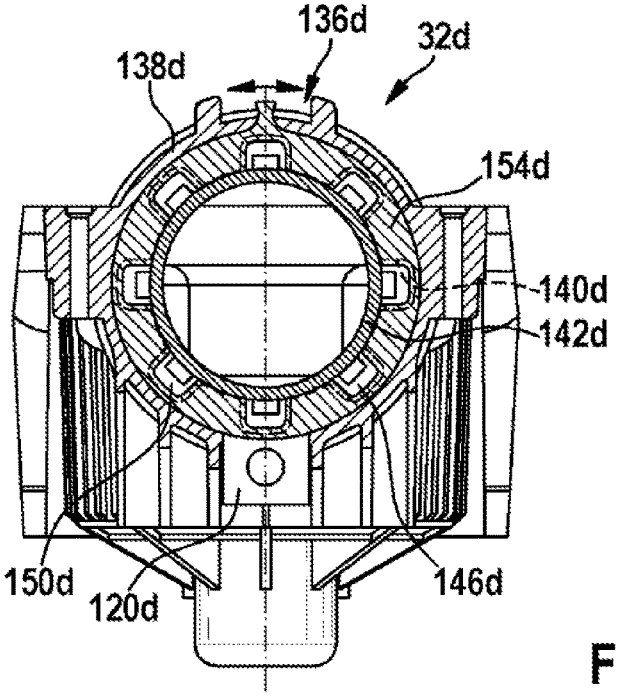
FIG. 17 shows a further schematic representation of the venting unit.

FIG. 16 and FIG. 17 show a percussion mechanism unit 10*d* for a rotary and percussion hammer 12*d* in a further exemplary embodiment. The percussion mechanism unit 10*d* differs from the preceding percussion mechanism unit in that an operating parameter defined by a control unit 14*d* is a throttle characteristic quantity of a venting unit 32*d*. A percussion space in a hammer tube 42*d* is delimited by a striking pin and a striker. The venting unit 32*d* has venting openings in the hammer tube 42*d* for venting the percussion space. The venting unit 32*d* serves to balance the pressure of the percussion space with an environment of a percussion mechanism 16*d*. The venting unit 32*d* has a setting unit 136*d*. The setting unit 136*d* is provided to influence venting of the percussion space, disposed in front of the striker in a percussion direction 56*d*, during a percussion operation. The hammer tube 42*d* of the percussion mechanism 16*d* is mounted in a transmission housing 138*d* of the rotary and percussion hammer 12*d*. The transmission housing 138*d* has ribs 140*d*, which are disposed in a star configuration and face toward an outside of the hammer tube 42*d*. Pressed in between the hammer tube 42*d* and the transmission housing 138*d*, in an end region 144*d* that faces toward an eccentric gear mechanism, there is a bearing bush 142*d*, which supports the hammer tube 42*d* on the transmission housing 138*d*. The bearing bush 142*d*, together with the ribs 140*d* of the transmission housing 138*d*, forms air channels 146*d*, which are connected to the venting openings in the hammer tube 42*d*. The air channels 146*d* constitute a part of the venting unit 32*d*. The percussion space is connected, via the air channels 146*d*, to a transmission space 148*d* disposed behind the hammer tube 42*d*, against the percussion direction 56*d*. The air channels 146*d* constitute throttle points 150*d*, which influence a flow cross section of the connection of the percussion space to the transmission space 148*d*. The setting unit 136*d* is provided to set the flow cross section of the throttle points 150*d*. The air channels 146*d* constituting throttle points 150*d* constitute a transition between the percussion space and the transmission space 148*d*. A setting ring 194*d* has inwardly directed valve extensions 154*d* disposed in a star configuration. Depending on a rotary position of the setting ring 194*d*, the valve extensions 154*d* can fully or partially overlap the air channels 46*d*. The flow cross section can be set by adjustment of the setting ring 194*d*. The control unit 14*d* adjusts the setting ring 194*d* of the setting unit 136*d* by rotating the setting ring 194*d* by means of a servo drive 120*d*. If the venting unit 32*d* is partially closed, the pressure in the percussion space that is produced upon a movement of the striker in the percussion direction 56*d* can escape only slowly. A counter-pressure forms, directed against the movement of the striker in the percussion direction 56*d*. This counter-pressure assists a return movement of the striker, against the percussion direction 56*d*, and thereby assists a percussion mechanism start. If the value selected for the percussion-mechanism rotational speed is an above-critical working value at which a reliable percussion mechanism start is not possible with the venting unit 32*d* open, the control unit 14*d* partially closes the venting unit 32*d*, for the purpose of changing from the idling operating mode to the percussion operating mode. Starting of the percussion operating mode is assisted by the counter-pressure in the percussion space. After the percussion mechanism has been started, the control unit 14*d* opens the venting unit 32*d* again. The control unit 14*d* can also use the operating parameter of the throttle characteristic quantity of the venting unit 32*d* for the purpose of regulating output.

The invention claimed is:

1. A percussion mechanism unit for at least one of a rotary hammer and a percussion hammer comprising:

a pneumatic percussion mechanism;

a motor configured to drive the pneumatic percussion mechanism; and a control unit configured to control the pneumatic percussion mechanism by at least one of open-loop control and closed-loop control, the control unit being further configured to:

receive a measured rotational speed of the motor; and estimate an unknown load on the motor caused by a percussion operating mode of the pneumatic percussion mechanism, the unknown load being estimated by subtracting rotational speed fluctuations corresponding to at least one known load from the measured rotational speed; and detect that the pneumatic percussion mechanism is operating in the percussion operating mode in response to the estimated unknown load exceeding a limit value.

2. The percussion mechanism unit as claimed in claim 1, wherein the control unit is configured to:

estimate the unknown load further based on a system model.

3. The percussion mechanism unit as claimed in claim 1, wherein one of the at least one known load is periodic with respect to one of (i) time and (ii) a rotational angle of the motor.

4. The percussion mechanism unit as claimed in claim 1, wherein the unknown load corresponds to a rotational speed fluctuation in the motor caused by the percussion operating mode of the pneumatic percussion mechanism.

5. The percussion mechanism unit as claimed in claim 1, wherein the control unit is configured to:

estimate the unknown load based on the measured rotational speed by filtering the measured rotational speed with a known frequency band of the unknown load.

6. The percussion mechanism unit as claimed in claim 1, wherein the control unit is configured to:

determine the at least one known load in a learning mode.

7. The percussion mechanism unit as claimed in claim 1, wherein the control unit is configured to estimate a driving torque of a drive unit using a dynamic model.

8. The percussion mechanism unit as claimed in claim 7, wherein the control unit is configured to determine model parameters of the dynamic model from a comparison of measured and estimated parameters.

9. The percussion mechanism unit as claimed in claim 7, wherein the control unit is configured to determine an operating state by comparing at least one parameter with at least one limit value.

10. The percussion mechanism unit as claimed in claim 1, wherein the control unit is configured, in at least one operating state, to set at least one operating parameter temporarily to a start value to change from an idling operating mode to a percussion operating mode.

11. The percussion mechanism unit as claimed in claim 10, wherein one of the at least one operating parameter is a throttle characteristic quantity of a venting unit.

12. The percussion mechanism unit as claimed in claim 10, wherein one of the at least one operating parameter is a percussion frequency.

13. The percussion mechanism unit as claimed in claim 1, further comprising:

a mode change sensor configured to signal a change of an operating mode.

14. A hand power tool, comprising:

a percussion mechanism unit, the percussion mechanism unit comprising:

a pneumatic percussion mechanism;

a motor configured to drive the pneumatic percussion mechanism; and a control unit configured to control the pneumatic percussion mechanism by at least one of open-loop control and closed-loop control, the control unit being further configured to:

receive a measured rotational speed of the motor; and estimate an unknown load on the motor caused by a percussion operating mode of the pneumatic percussion mechanism, the unknown load being estimated by subtracting rotational speed fluctuations corresponding to at least one known load from the measured rotational speed; and detect that the pneumatic percussion mechanism is operating in the percussion operating mode in response to the estimated unknown load exceeding a limit value.

15. A method for estimating a load for a percussion mechanism unit having a pneumatic percussion mechanism, a motor configured to drive the pneumatic percussion mechanism, and a control unit configured to control the pneumatic percussion mechanism by at least one of open-loop control and closed-loop control, the method comprising:

receiving a measured rotational speed of the motor;

estimating an unknown load on the motor by bandpass filtering the measured rotational speed with a frequency band corresponding to a known percussion frequency of a percussion operating mode of the pneumatic percussion mechanism;

identifying whether the pneumatic percussion mechanism is operating in the percussion operating mode based on the estimated unknown load;

identifying whether the pneumatic percussion mechanism is operating in an idling operating mode based on the estimated unknown load; and estimating a driving torque of a drive unit using a dynamic model.

16. The percussion mechanism unit as claimed in claim 3, wherein a setpoint value for a rotational speed of the pneumatic percussion mechanism is raised to a speed corresponding to a working frequency in response to the percussion operative mode being identified.

17. The percussion mechanism unit as claimed in claim 1, wherein the rotational speed fluctuations corresponds to at least one of (i) a known variable transmission ratio of the at least one of the rotary hammer and the percussion hammer, (ii) a known motor cyclic irregularity of the at least one of the rotary hammer and the percussion hammer, and (iii) an known irregular voltage supply of the at least one of the rotary hammer and the percussion hammer.

* * * * *